US009829205B2

(12) United States Patent
Morimoto et al.

(10) Patent No.: US 9,829,205 B2
(45) Date of Patent: Nov. 28, 2017

(54) AIR-CONDITIONING APPARATUS

(75) Inventors: Hiroyuki Morimoto, Tokyo (JP); Koji Yamashita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1262 days.

(21) Appl. No.: 13/879,653

(22) PCT Filed: Jan. 20, 2011

(86) PCT No.: PCT/JP2011/000280

§ 371 (c)(1),
(2), (4) Date: Apr. 16, 2013

(87) PCT Pub. No.: WO2012/098581

PCT Pub. Date: Jul. 26, 2012

(65) Prior Publication Data

US 2013/0205818 A1 Aug. 15, 2013

(51) Int. Cl.
*F24F 3/06* (2006.01)
*F24F 11/00* (2006.01)
(Continued)

(52) U.S. Cl.
CPC ..... *F24F 3/06* (2013.01); *F24F 11/001* (2013.01); *F24F 11/008* (2013.01); *F25B 25/005* (2013.01); *F24F 2001/0077* (2013.01); *F24F 2011/0043* (2013.01); *F24F 2011/0045* (2013.01); *F25B 13/00* (2013.01); *F25B 45/00* (2013.01); *F25B 2313/023* (2013.01); *F25B 2313/0231* (2013.01);
(Continued)

(58) Field of Classification Search
CPC ..... F24F 3/06; F24F 1/02; B60H 1/00357; B60H 1/00414; B60H 1/3222; F24D 3/04
USPC ..... 62/160, 175, 239, 430, 196.1
See application file for complete search history.

(56) References Cited

U.S. PATENT DOCUMENTS 9,316,420 B2 * 4/2016 Yamashita ..... F25B 25/005
2004/0026075 A1 * 2/2004 Park ..... F24D 3/04 165/218
(Continued)

FOREIGN PATENT DOCUMENTS

JP 2000-104940 A 4/2000
JP 2000-276985 A 10/2000
(Continued)

OTHER PUBLICATIONS

Office Action dated Jan. 21, 2014 in corresponding JP application No. 2012-553459 (English Translation).
(Continued)

*Primary Examiner* — Dominick L Plakkoottam
*Assistant Examiner* — Meraj A Shaikh
(74) *Attorney, Agent, or Firm* — Posz Law Group, PLC

(57) ABSTRACT

In an air-conditioning apparatus including a refrigerant circulating circuit A and a heat medium circulating circuit B that performs passing of heat to and from the refrigerant circulating circuit A, the heat medium circulating circuit is a closed circuit, the maximum pump head Pp of a pump of the heat medium circulating circuit is 150 kPa or more, and a pressure near at least a suction side of the pump is set to a charged pressure that is maintained equal to or higher than the atmospheric pressure during operation of the pump.

10 Claims, 9 Drawing Sheets

(51) Int. Cl.

| | |
|---|---|
| ***F25B 25/00*** | (2006.01) |
| *F25B 13/00* | (2006.01) |
| *F25B 45/00* | (2006.01) |
| *F24F 1/00* | (2011.01) |

(52) U.S. Cl.
CPC ..... *F25B 2313/0272* (2013.01); *F25B 2313/02732* (2013.01); *F25B 2313/02741* (2013.01)

(56) References Cited

U.S. PATENT DOCUMENTS

| | | | | |
|---|---|---|---|---|
| 2006/0234621 | A1* | 10/2006 | Desrochers | F24F 3/044 454/239 |
| 2007/0193291 | A1* | 8/2007 | Reddin | B60H 1/00357 62/239 |
| 2011/0192184 | A1* | 8/2011 | Yamashita | F24F 1/02 62/196.1 |
| 2012/0043054 | A1* | 2/2012 | Shimazu | F25B 13/00 165/58 |

FOREIGN PATENT DOCUMENTS

| | | | | | |
|---|---|---|---|---|---|
| JP | 2000276985 | A | * | 10/2000 | |
| JP | 2003-106985 | A | | 4/2003 | |
| JP | 2006-036171 | A | | 2/2006 | |
| JP | 2006036171 | A | * | 2/2006 | |
| JP | WO 2010049998 | A1 | * | 5/2010 | F24F 1/02 |
| JP | WO 2010131335 | A1 | * | 11/2010 | F25B 13/00 |
| WO | 2010/049998 | A1 | | 5/2010 | |
| WO | 2010/050004 | A1 | | 5/2010 | |

OTHER PUBLICATIONS

International Search Report of the International Searching Authority dated Apr. 11, 2011 for the corresponding international application No. PCT/JP2011/000280 (with English translation).
Extended European Search Report dated Oct. 21, 2014 in corresponding EP application No. 11856402.0 (In English).
Office Action dated Jun. 10, 2014 in corresponding EP application No. 11856402.0 (In English).

* cited by examiner

AIR-CONDITIONING APPARATUS

CROSS REFERENCE TO RELATED APPLICATIONS

This application is a U.S. national stage application of PCT/JP2011/000280 filed on Jan. 20, 2011.

TECHNICAL FIELD

The present invention relates to an air-conditioning apparatus applied to, for example, a multi-air-conditioning apparatus for buildings.

BACKGROUND ART

In air-conditioning apparatuses such as multi-air-conditioning apparatuses for buildings, a refrigerant has been hitherto circulated between an outdoor unit, which is a heat source unit arranged outside a room, and an indoor unit arranged inside the room. The refrigerant has radiated or absorbed heat, and a space to be air-conditioned has been cooled or heated with heated or cooled air. In the case of such a multi-air-conditioning apparatus for buildings, a plurality of indoor units are connected, and indoor units that are not operating and indoor units that are operating often co-exist. Furthermore, since a pipe connecting an indoor unit with an outdoor unit can have a maximum length of as much as 100 m. A system is filled with a larger amount of refrigerant, as the length of a pipe increases.

Such indoor units of multi-air-conditioning apparatuses for buildings are normally placed inside a room used by people (for example, office spaces, living rooms, retail premises, etc.). If a refrigerant leaks from an indoor unit arranged inside a room for some reason, the leakage, depending on the type of the refrigerant, can be a problem of significance, from the viewpoint of safety and harmful effects to humans. In order to address the problem described above, a method in which a two-loop system is employed for an air-conditioning apparatus is known. In the method, air conditioning is performed where a refrigerant is used for a primary loop while water or brine is used for a secondary loop corresponding to an indoor space. In this system, since water, brine, or the like is used for the secondary side, a transfer unit such as a pump is required. If air intrudes into a secondary circuit due to negative pressure or the like of the secondary circuit, air entrainment may occur in operation of a pump, and thus water does not flow. Furthermore, idling run of the pump may cause breakdown of the pump. Under such circumstances, a technique for preventing the pressure of the secondary circuit from becoming negative and preventing air from intruding into the secondary circuit is disclosed.

For example, in Patent Literature 1, by providing an open atmospheric tank including an air-pressure equalizing valve on the pump suction side, the pressure at pump suction is prevented from becoming negative. Furthermore, as in Patent Literature 2, by providing a water-level tank and maintaining the water level of the water-level tank constant, the pressure is prevented from becoming negative.

In Patent Literatures 1 and 2, however, a number of parts increases, which leads to the cost increase, and a tank needs to be installed at a limited position. Thus, the techniques of Patent Literatures 1 and 2 are not suitable as versatile multi-air-conditioning apparatuses for buildings where diverse installations thereof can be assumed.

CITATION LIST

Patent Literature

Patent Literature 1: Japanese Unexamined Patent Application Publication No. 2006-36171 (Paragraph [0134], FIG. 1 etc.)

Patent Literature 2: Japanese Unexamined Patent Application Publication No. 2003-106985 (Paragraph [0034], FIG. 3 etc.)

SUMMARY OF INVENTION

Technical Problem

The present invention has been designed to solve the above-described problems and provides an air-conditioning apparatus of ensured safety and increases its reliability without reducing the flexibility in installation of a system by preventing air from intruding into a secondary circuit in which water or the like flows and by suppressing breakdown of a pump.

Solution to Problem

An air-conditioning apparatus includes a refrigerant circuit in which a compressor, a heat-source-side heat exchanger, an expansion device, and a refrigerant-side flow of a heat exchanger related to heat medium are connected in series and through which a heat medium circulating circuit circulates; and a heat medium circulating circuit in which a heat-medium-side flow of the heat exchanger related to heat medium, a pump, a use-side heat exchanger, and a heat medium flow control device are connected and through which a heat medium circulates. The compressor and the heat-source-side heat exchanger are arranged in an outdoor unit. The heat exchanger related to heat medium, the expansion device, the pump, and the heat medium flow control device are arranged in a heat medium relay unit. The use-side heat exchanger is arranged in an indoor unit. The heat medium circulating circuit is a closed circuit, the maximum pump head Pp of the pump is 150 kPa or more, and a pressure near at least a suction side of the pump is set to a charged pressure that is maintained equal to or higher than an atmospheric pressure during operation of the pump.

Advantageous Effects of Invention

In an air-conditioning apparatus according to the present invention, the pressure in a heat medium circulating circuit through which water or the like flows is always maintained equal to or higher than the atmospheric pressure, and air is prevented from intruding into the heat medium circulating circuit. Accordingly, the reliability of the air-conditioning apparatus is improved.

DESCRIPTION OF EMBODIMENTS

Hereinafter, embodiments of the present invention will be described with reference to the drawings.

Embodiment 1

Figure 1:
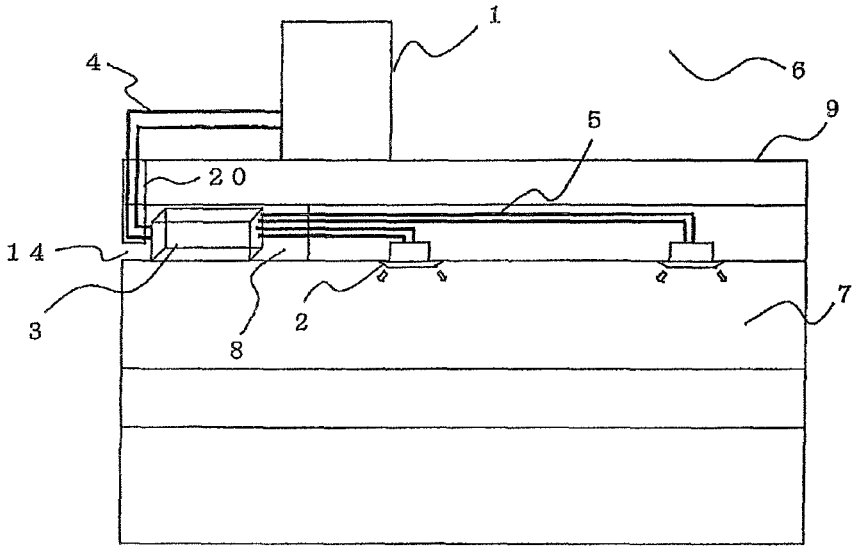
FIG. 1 is a schematic diagram illustrating an installation example of an air-conditioning apparatus according to an embodiment of the present invention.

FIG. 1 is a schematic diagram illustrating an installation example of an air-conditioning apparatus according to the present invention. The installation example of the air-conditioning apparatus will be described with reference to FIG. 1. In the air-conditioning apparatus, with the use of a refrigeration cycle (refrigerant circulating circuit A) for circulating a refrigerant and a secondary circuit (heat-medium-side passage B) for circulating a heat medium, indoor units arranged in the secondary circuit can arbitrarily select between a cooling mode and a heating mode as an operation mode.

The air-conditioning apparatus according to the present invention adopts a method for indirectly using a refrigerant (indirect method). That is, cooling energy or heating energy stored in a refrigerant is transmitted to a heat medium that is different from the refrigerant, and a space to be air-conditioned is cooled or heated with the cooling energy or the heating energy stored in the heat medium.

Referring to FIG. 1, the air-conditioning apparatus according to Embodiment 1 includes a single outdoor unit 1 serving as a heat source unit, a plurality of indoor units 2, and a heat medium relay unit 3 arranged between the outdoor unit 1 and each of the indoor units 2. The heat medium relay unit 3 exchanges heat between a refrigerant and a heat medium. The outdoor unit 1 and the heat medium relay unit 3 are connected by pipes (refrigerant pipes) 4 through which the refrigerant flows. The heat medium relay unit 3 and each of the indoor units 2 are connected by pipes (heat medium pipes) 5 through which the heat medium flows. Cooling energy or heating energy generated by the outdoor unit 1 is sent through the heat medium relay unit 3 to the indoor units 2.

Normally, the outdoor unit 1 is arranged in an outdoor space 6, which is a space (for example, a rooftop etc.) outside a structure 9 such as a building, and supplies cooling energy or heating energy through the heat medium relay unit 3 to the indoor units 2. The indoor units 2 are arranged at positions from which cooling air or heating air can be supplied to an indoor space 7, which is a space (for example, a living room etc.) inside the structure 9, and supplies cooling air or heating air to the indoor space 7 serving as a space to be air-conditioned. The heat medium relay unit 3 is configured so as to be installed, as a housing different from the outdoor unit 1 and the indoor units 2, at a position different from the outdoor space 6 and the indoor space 7. The heat medium relay unit 3 is connected to the outdoor unit 1 and the indoor units 2 by the pipes 4 and the pipes 5, respectively, and transmits to the indoor units 2 cooling energy or heating energy supplied from the outdoor unit 1.

As illustrated in FIG. 1, in the air-conditioning apparatus according to the present invention, the outdoor unit 1 and the heat medium relay unit 3 are connected by the two pipes 4, and the heat medium relay unit 3 and each of the indoor units 2 are connected by the two pipes 5. As described above, in an air-conditioning apparatus according to Embodiment 2, since individual units (the outdoor unit 1, the indoor units 2, and the heat medium relay unit 3) are connected using two pipes, construction can be facilitated.

In FIG. 1, the state in which the heat medium relay unit 3 is installed in a space (for example, a space such as a space above a ceiling of the structure 9, hereinafter, simply referred to as a space 8) such as a space above a ceiling or the like, which is a space inside the structure 9 but is different from the indoor space 7, is exemplified. The heat medium relay unit 3 may be installed in a shared space or the like where an elevator or the like is located. Furthermore, although the case where the indoor units 2 are of a ceiling cassette type is exemplified in FIG. 1, the type of the indoor units 2 is not necessarily of a ceiling cassette type. The indoor units 2 may be of any type, such as a ceiling-concealed type or a ceiling-suspended type, as long as they are capable of blowing heating air or cooling air to the indoor space 7 directly or via ducts or the like.

Although the case where the outdoor unit 1 is installed in the outdoor space 6 is exemplified in FIG. 1, the outdoor unit 1 is not necessarily installed in the outdoor space 6. For example, the outdoor unit 1 may be installed in a surrounded space such as a machine room provided with a ventilating opening. The outdoor unit 1 may be installed inside the structure 9 as long as waste heat can be discharged outside the structure 9 through an exhaust duct, or the outdoor unit 1 of a water-cooled type may be installed inside the structure 9. Even in the case where the outdoor unit 1 is installed in the above-mentioned place, there would be no particular problem.

Furthermore, the heat medium relay unit 3 may be installed in the vicinity of the outdoor unit 1. However, if the distance from the heat medium relay unit 3 to each of the indoor units 2 is too long, the conveyance power for a heat medium is significantly increased. Accordingly, it is necessary to pay attention to the fact that the energy-saving effect is reduced. Furthermore, the number of connected units, namely, the outdoor unit 1, the indoor units 2, and the heat medium relay unit 3 is not necessarily equal to the number illustrated in FIG. 1. The number of connected units can be determined in accordance with the structure 9 in which the air-conditioning apparatus according to the present invention is installed.

Figure 2:
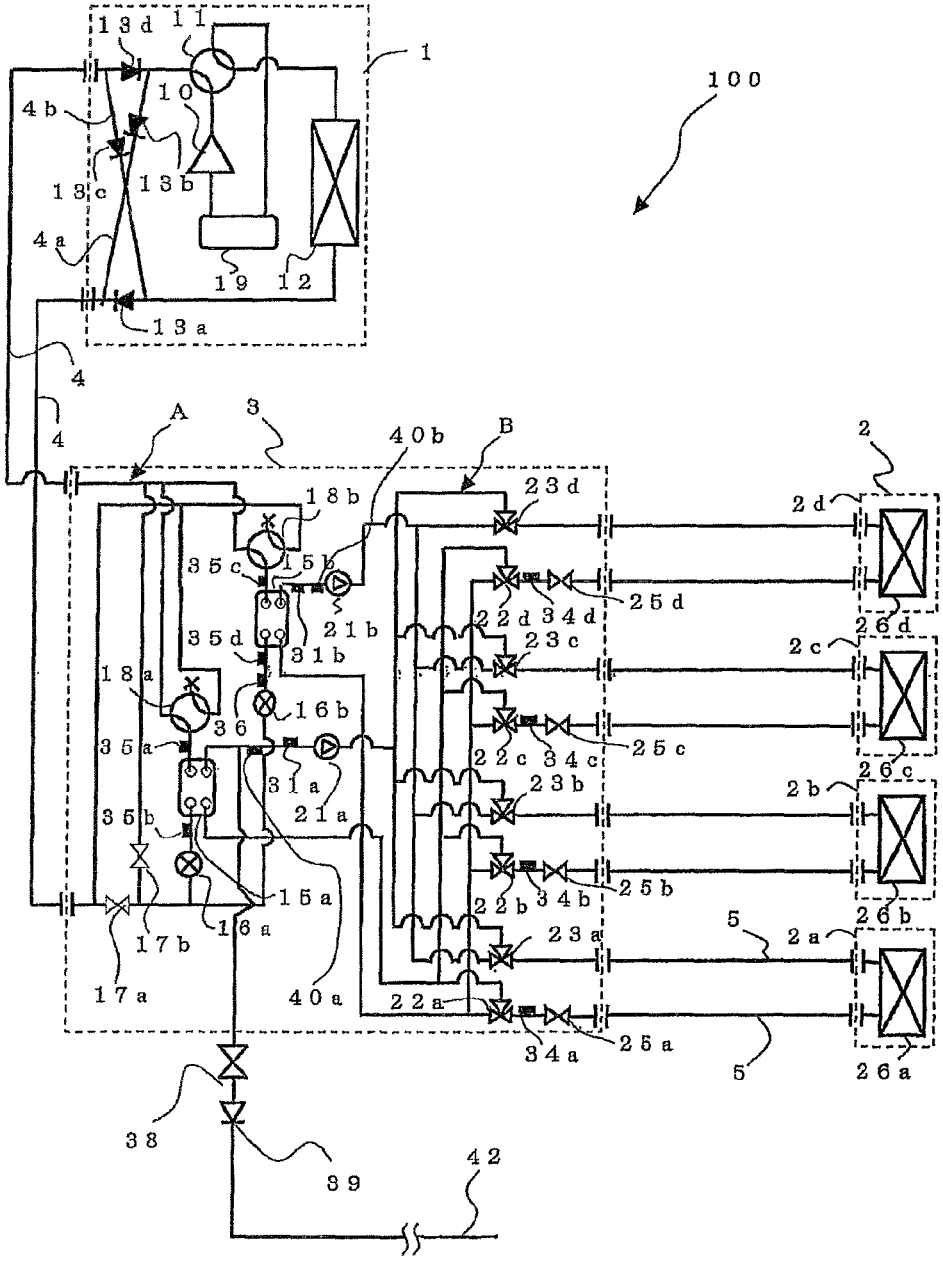
FIG. 2 is a schematic circuit diagram illustrating an example of the circuit configuration of the air-conditioning apparatus according to the embodiment of the present invention.

FIG. 2 is a schematic circuit diagram illustrating an example of the circuit configuration of an air-conditioning apparatus (hereinafter, referred to as 100) according to Embodiment 2. The detailed configuration of the air-conditioning apparatus 100 will be described with reference to FIG. 2. As illustrated in FIG. 2, the outdoor unit 1 and the heat medium relay unit 3 are connected by the pipes 4 through a heat exchanger related to heat medium 15*a* and a heat exchanger related to heat medium 15*b* that are provided in the heat medium relay unit 3. In addition, the heat medium relay unit 3 and the each of the indoor units 2 are connected by the pipes 5 through the heat exchanger related to heat medium 15*a* and the heat exchanger related to heat medium 15*b*.

[Outdoor Unit 1]

A compressor 10, a first refrigerant flow switching device 11 having a four-way valve or the like, a heat-source-side heat exchanger 12, and an accumulator 19 are connected in series by the pipes 4 and are mounted in the outdoor unit 1.

Furthermore, a first connecting pipe 4*a*, a second connecting pipe 4*b*, and check valves 13*a* to 13*d* are provided in the outdoor unit 1. With the provision of the first connecting pipe 4*a*, the second connecting pipe 4*b*, and the check valves 13*a* to 13*d*, the flow of a refrigerant caused to be flowed into the heat medium relay unit 3 can be maintained in a constant direction, irrespective of operation required by the indoor units 2.

The compressor 10 sucks a refrigerant and compresses the refrigerant into a high-temperature and high-pressure state. The compressor 10 includes, for example, an inverter compressor or the like capable of performing capacity control. The first refrigerant flow switching device 11 performs switching between the flow of a refrigerant in a heating operation mode (heating only operation mode and heating main operation mode) and the flow of a refrigerant in a cooling operation mode (cooling only operation mode and cooling main operation mode).

The heat-source-side heat exchanger 12 functions as an evaporator at the time of heating operation and functions as a radiator (gas cooler) at the time of cooling operation. The heat-source-side heat exchanger 12 exchanges heat between air supplied from an air-sending device such as a fan or the like, which is not illustrated, and a refrigerant. The accumulator 19 is arranged on the suction side of the compressor 10. The accumulator 19 accumulates an excessive refrigerant caused by a difference between the heating operation mode and the cooling operation mode and an excessive refrigerant for a transient operation change (for example, a change in the number of operating indoor units 2).

[Indoor Unit 2]

Use-side heat exchangers 26 (26*a* to 26*d*) are mounted in the indoor units 2. The use-side heat exchangers 26 are connected to heat medium flow control devices 25 (25*a* to 25*d*) and second heat medium flow switching devices 23 (23*a* to 23*d*) by the pipes 5. The use-side heat exchangers 26 exchange heat between air supplied from an air-sending device such as a fan, which is not illustrated, and a heat medium, and generate heating air or cooling air to be supplied to the indoor space 7.

[Heat Medium Relay Unit 3]

The two heat exchangers related to heat medium 15, two expansion devices 16, two opening/closing devices 17*a* and 17*b*, two second refrigerant flow switching devices 18, two pumps 21, four first heat medium flow switching devices 22, four second heat medium flow switching devices 23, and four heat medium flow control devices 25 are arranged in the heat medium relay unit 3.

The two heat exchangers related to heat medium 15 (15*a* and 15*b*) function as condensers (radiators) or evaporators, exchange heat between a refrigerant and a heat medium, and transmit cooling energy or heat energy generated by the outdoor unit 1 and stored in the refrigerant to the heat medium. The heat exchanger related to heat medium 15*a* is arranged between the expansion device 16*a* and the second refrigerant flow switching device 18*a* in the refrigerant circulating circuit A and is used for cooling a heat medium in cooling and heating mixed operation mode. The heat exchanger related to heat medium 15*b* is arranged between the expansion device 16*b* and the second refrigerant flow switching device 18*b* in the refrigerant circulating circuit A and is used for heating a heat medium in the cooling and heating mixed operation mode.

The two expansion devices 16 (16*a* and 16*b*) each have a function of a pressure reducing valve and an expansion valve and reduce the pressure of a refrigerant to expand the refrigerant. The expansion device 16*a* is arranged on the upstream side of the heat exchanger related to heat medium 15*a* in the flow of a refrigerant in the cooling only operation mode. The expansion device 16*b* is arranged on the upstream side of the heat exchanger related to heat medium 15*b* in the flow of a refrigerant in the cooling only operation mode. The two expansion devices 16 may be devices capable of variably controlling the opening degree, such as electronic expansion valves or the like.

The opening/closing devices 17 (17*a* and 17*b*) each include a two-way valve or the like, and open and close the pipes 4.

The two second refrigerant flow switching devices 18 (18*a* and 18*b*) each include a four-way valve, and perform switching of the flow of a refrigerant in accordance with an operation mode. The second refrigerant flow switching device 18*a* is arranged on the downstream side of the heat exchanger related to heat medium 15*a* in the flow of a refrigerant in the cooling only operation mode. The second refrigerant flow switching device 18*b* is arranged on the downstream side of the heat exchanger related to heat medium 15*b* in the flow of a refrigerant in the cooling only operation mode.

The two pumps 21 (21*a* and 21*b*) allow a heat medium which flows through the pipes 5 to circulate. The pump 21*a* is arranged in the pipes 5 between the heat exchanger related to heat medium 15*a* and the second heat medium flow switching devices 23. The pump 21*b* is arranged in the pipes 5 between the heat exchanger related to heat medium 15*b* and the second heat medium flow switching devices 23. The two pumps 21 may be, for example, pumps capable of performing capacity control. The pump 21*a* may be arranged in the pipes 5 between the heat exchanger related to heat medium 15*a* and the first heat medium flow switching devices 22. The pump 21*b* may be arranged in the pipes 5 between the heat exchanger related to heat medium 15*b* and the first heat medium flow switching devices 22.

The four first heat medium flow switching devices 22 (22*a* to 22*d*) each include a three-way valve or the like and perform switching of the flow of a heat medium. The number of the installed first heat medium flow switching devices 22 corresponds to the number of the installed indoor units 2 (here, four). One of the three ways of each of the first heat medium flow switching devices 22 is connected to the heat exchanger related to heat medium 15*a*, another one of the three ways is connected to the heat exchanger related to heat medium 15*b*, and the other one of the three ways is connected to the corresponding one of the heat medium flow control devices 25. The first heat medium flow switching devices 22 are arranged on the outlet side of the heat medium passage of the corresponding use-side heat exchangers 26. The first heat medium flow switching device 22*a*, the first heat medium flow switching device 22*b*, the first heat medium flow switching device 22*c*, and the first heat medium flow switching device 22*d* are illustrated in that order from the bottom side in the drawing, corresponding to the indoor units 2.

The four second heat medium flow switching devices 23 (23*a* to 23*d*) each include a three-way valve or the like and perform switching of the flow of a heat medium. The number of the installed second heat medium flow switching devices 23 corresponds to the number of the installed indoor units 2 (here, four). One of the three ways of each of the second heat medium flow switching devices 23 is connected to the heat exchanger related to heat medium 15*a*, another one of the three ways is connected to the heat exchanger related to heat medium 15*b*, and the other one of the three ways is connected to the corresponding one of the use-side heat exchangers 26. The second heat medium flow switching devices 23 are arranged on the inlet side of the heat medium passage of the corresponding use-side heat exchangers 26. The second heat medium flow switching device 23*a*, the second heat medium flow switching device 23*b*, the second heat medium flow switching device 23*c*, and the second heat medium flow switching device 23*d* are illustrated in that order from the bottom side in the drawing, corresponding to the indoor units 2.

The four heat medium flow control devices 25 (25*a* to 25*d*) each include a two-way valve or the like capable of controlling the opening area and control the flow rate of a heat medium flowing to the indoor units 2. The number of the installed heat medium flow control devices 25 corresponds to the number of the installed indoor units 2 (here, four). One of the two ways of each of the heat medium flow control devices 25 is connected to the corresponding one of the use-side heat exchangers 26 and the other one of the two ways is connected to the corresponding one of the first heat medium flow switching devices 22. The heat medium flow control devices 25 are arranged on the outlet side of the heat medium passage of the use-side heat exchangers 26. The heat medium flow control device 25*a*, the heat medium flow control device 25*b*, the heat medium flow control device 25*c*, and the heat medium flow control device 25*d* are illustrated in that order from the bottom side in the drawing, corresponding to the indoor units 2. The heat medium flow control devices 25 may be arranged on the inlet side of the heat medium passage of the use-side heat exchangers 26.

Furthermore, various detecting means (two first temperature sensors 31, four second temperature sensors 34, four third temperature sensors 35, and one pressure sensor 36) are provided in the heat medium relay unit 3. Information detected by the detecting means (for example, temperature information, pressure information, and refrigerant density information) is transmitted to a controller (not illustrated) that performs integrated control of the operation of the air-conditioning apparatus 100. The transmitted information is used for controlling the driving frequency of the compressor 10, the rotation speed of air-sending devices, which are not illustrated, provided in the vicinity of the heat-source-side heat exchanger 12 and the use-side heat exchangers 26, switching of the first refrigerant flow switching device 11, the driving frequency of the pumps 21, switching of the second refrigerant flow switching devices 18, switching of the flow of a heat medium, and the like.

The two first temperature sensors 31 (31*a* and 31*b*) detect the temperatures of a heat medium flows out of the heat exchangers related to heat medium 15, that is, a heat medium at the outlet of the heat exchangers related to heat medium 15*a* and 15*b*. The first temperature sensors 31 may be, for example, thermistors or the like. The first temperature sensor 31*a* is arranged in the pipe 5 on the inlet side of the pump 21*a*. The first temperature sensor 31*b* is arranged in the pipe 5 on the inlet side of the pump 21*b*.

The four second temperature sensors 34 (34*a* to 34*d*) are arranged between the first heat medium flow switching devices 22 and the heat medium flow control devices 25, and detect the temperature of a heat medium flows out of the use-side heat exchangers 26. The second temperature sensors 34 may be, for example, thermistors or the like. The number of the installed second temperature sensors 34 corresponds to the number of the installed indoor units 2 (here, four). The second temperature sensor 34*a*, the second temperature sensor 34*b*, the second temperature sensor 34*c*, and the second temperature sensor 34*d* are illustrated in that order from the bottom side in the drawing, corresponding to the indoor units 2.

The four third temperature sensors 35 (35*a* to 35*d*) are arranged on the inlet side or the outlet side for a refrigerant of the heat exchangers related to heat medium 15 and detect the temperature of a refrigerant flowing into the heat exchangers related to heat medium 15 or the temperature of a refrigerant flowing out of the heat exchangers related to heat medium 15. The third temperature sensors 35 may be thermistors or the like. The third temperature sensor 35*a* is arranged between the heat exchanger related to heat medium 15*a* and the second refrigerant flow switching device 18*a*. The third temperature sensor 35*b* is arranged between the heat exchanger related to heat medium 15*a* and the expansion device 16*a*. The third temperature sensor 35*c* is arranged between the heat exchanger related to heat medium 15*b* and the second refrigerant flow switching device 18*b*. The third temperature sensor 35*d* is arranged between the heat exchanger related to heat medium 15*b* and the expansion device 16*b*.

Similarly to the position where the third temperature sensor 35*d* is arranged, the pressure sensor 36 is arranged between the heat exchanger related to heat medium 15*b* and the expansion device 16*b*. The pressure sensor 36 detects the pressure of a refrigerant flowing between the heat exchanger related to heat medium 15*b* and the expansion device 16*b*.

The pipes 5 through which a heat medium flows include pipes connected to the heat exchanger related to heat medium 15*a* and pipes connected to the heat exchanger related to heat medium 15*b*. The pipes 5 branch off in accordance with the number of the indoor units 2 connected to the heat medium relay unit 3. The pipes 5 are connected through the first heat medium flow switching devices 22 and the second heat medium flow switching devices 23. By controlling the first heat medium flow switching devices 22 and the second heat medium flow switching devices 23, determination as to whether a heat medium from the heat exchanger related to heat medium 15*a* is to be flowed into the use-side heat exchangers 26 or a heat medium from the heat exchanger related to heat medium 15*b* is to be flowed into the use-side heat exchangers 26 is made.

The compressor 10, the first refrigerant flow switching device 11, the heat-source-side heat exchanger 12, the opening/closing devices 17, the second refrigerant flow switching devices 18, the refrigerant flows for the heat exchangers related to heat medium 15, the expansion devices 16, and the accumulator 19 are connected to form the refrigerant circulating circuit A in the air-conditioning apparatus 100. Furthermore, the heat medium passages for the heat exchangers related to heat medium 15, the pumps 21, the first heat medium flow switching devices 22, the heat medium flow control devices 25, the use-side heat exchangers 26, and the second heat medium flow switching devices 23 are connected to form a heat medium circulating circuit B. That is, the plurality of use-side heat exchangers 26 are connected in parallel to each of the heat exchangers related to heat medium 15, so that the heat medium circulating circuit B is formed as a multiple system.

Accordingly, in the air-conditioning apparatus 100, the outdoor unit 1 and the heat medium relay unit 3 are connected through the heat exchanger related to heat medium 15*a* and the heat exchanger related to heat medium 15*b* which are provided in the heat medium relay unit 3, and the heat medium relay unit 3 and the indoor units 2 are connected through the heat exchanger related to heat medium 15*a* and the heat exchanger related to heat medium 15*b*. That is, in the air-conditioning apparatus 100, heat exchange is performed, in the heat exchanger related to heat medium 15*a* and the heat exchanger related to heat medium 15*b*, between a refrigerant circulating in the refrigerant circulating circuit A and a heat medium circulating in the heat medium circulating circuit B.

Furthermore, a controller, which is not illustrated, is provided in the air-conditioning apparatus 100. The controller includes a microcomputer or the like. The controller controls the driving frequency of the compressor 10, the rotation speed (including ON/OFF) of the air-sending devices, switching of the first refrigerant flow switching device 11, driving of the pumps 21, the opening degree of the expansion devices 16, opening and closing of the opening/closing devices 17, switching of the second refrigerant flow switching devices 18, switching of the first heat medium flow switching devices 22, switching of the second heat medium flow switching devices 23, the opening degree of the heat medium flow control devices 25, and the like, on the basis of detection information by the various detecting means and instructions from a remote control, and executes various operation modes, which will be described later. The controller may be provided for individual units or may be provided in the outdoor unit 1 or the heat medium relay unit 3.

Furthermore, a pressure reducing valve 38 for reducing the pressure at the source, such as a water pipe, and a check valve 39 for preventing reverse flow from the heat medium circulating circuit to a heat medium supply source (for example, a water pipe 42) are provided in the air-conditioning apparatus 100. These valves will be described later in detail.

Next, various operation modes executed by the air-conditioning apparatus 100 will be described. The air-conditioning apparatus 100 is capable of executing, with each of the indoor units 2, cooling operation or heating operation on the basis of an instruction from the indoor unit 2. That is, the air-conditioning apparatus 100 is capable of allowing all the indoor units 2 to perform the same operations and allowing the individual indoor units 2 to perform different operations.

The operation modes executed by the air-conditioning apparatus 100 include a cooling only operation mode in which all of the operating indoor units 2 perform cooling operation, a heating only operation mode in which all of the operating indoor units 2 perform heating operation, a cooling main operation, which is a cooling and heating mixed operation mode in which the cooling load is larger, and a heating main operation, which is a cooling and heating mixed operation mode in which the heating load is larger. Hereinafter, the various operation modes with respect to the flow of a refrigerant and a heat medium will be described with reference to FIGS. 3 to 6. In FIGS. 3 to 6, the pressure reducing valve 38, the check valve 39, and pressure sensors 40*a* and 40*b* are not illustrated.

[Cooling Only Operation Mode]

Figure 3:
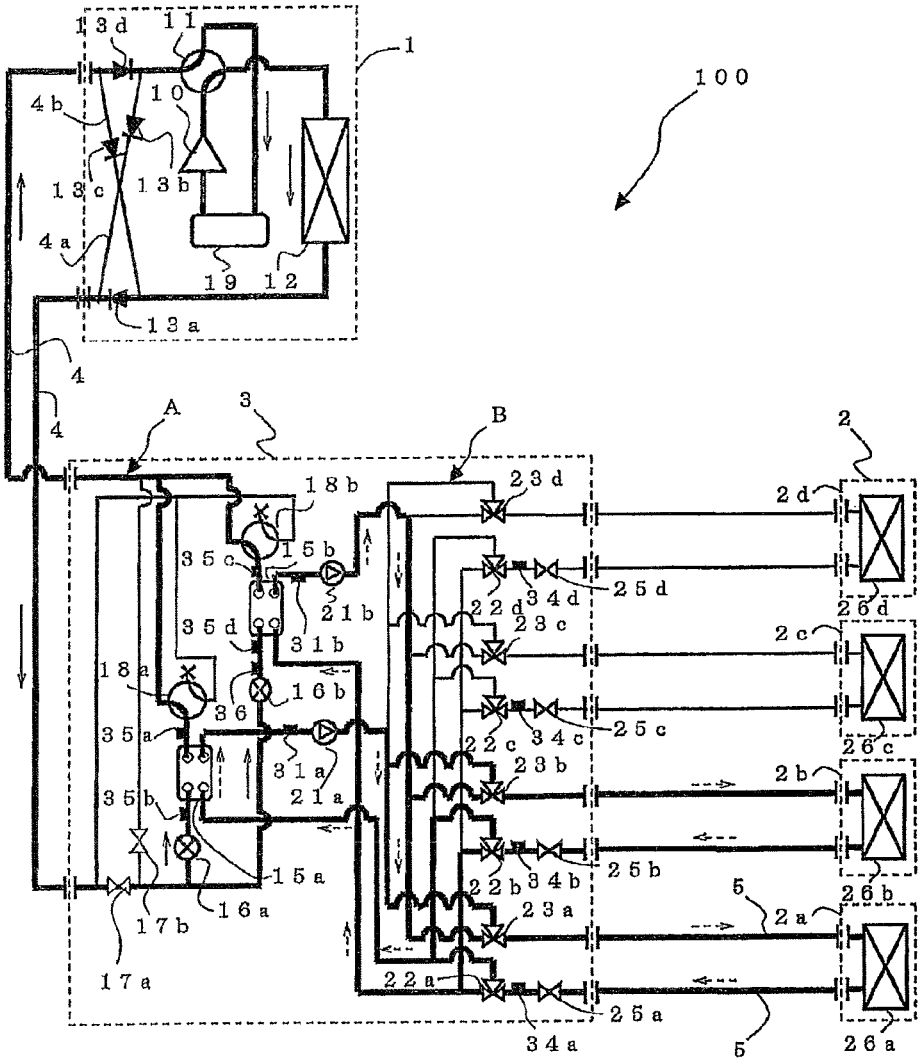
FIG. 3 is a refrigerant circuit diagram illustrating the flow of a refrigerant when the air-conditioning apparatus according to the embodiment of the present invention is in a cooling only operation mode.

FIG. 3 is a refrigerant circuit diagram illustrating the flow of a refrigerant and a heat medium when the air-conditioning apparatus 100 is in the cooling only operation mode. With reference to FIG. 3, the cooling only operation mode will be described by way of an example of the case where cooling load is generated only in the use-side heat exchanger 26*a* and the use-side heat exchanger 26*b*. In FIG. 3, pipes expressed by thick lines represent pipes through which the refrigerant and the heat medium flow. In addition, in FIG. 3, the direction of the flow of the refrigerant is expressed by solid-line arrows and the direction of the flow of the heat medium is expressed by broken-line arrows.

In the case of the cooling only operation mode illustrated in FIG. 3, the outdoor unit 1 causes the first refrigerant flow switching device 11 to switch in such a manner that the refrigerant discharged from the compressor 10 flows into the heat-source-side heat exchanger 12. In the heat medium relay unit 3, the pump 21*a* and the pump 21*b* are driven, the heat medium flow control device 25*a* and the heat medium flow control device 25*b* are opened while the heat medium flow control device 25*c* and the heat medium flow control device 25*d* are fully closed, so that the heat medium circulates between each of the heat exchanger related to heat medium 15*a* and the heat exchanger related to heat medium 15*b* and the use-side heat exchanger 26*a* and circulates between each of the heat exchanger related to heat medium 15*a* and the heat exchanger related to heat medium 15*b* and the use-side heat exchanger 26*b*.

First, a flow of a refrigerant in the refrigerant circulating circuit A will be described.

A low-temperature and low-pressure refrigerant is compressed by the compressor 10 and is discharged as a high-temperature and high-pressure gas refrigerant. The high-temperature and high-pressure gas refrigerant discharged from the compressor 10 passes through the first refrigerant flow switching device 11 and flows into the heat-source-side heat exchanger 12. Then, the gas refrigerant is liquefied into a high-pressure liquid refrigerant while radiating heat to outdoor air. The high-pressure refrigerant that has flowed out of the heat-source-side heat exchanger 12 passes through the check valve 13*a*, flows out of the outdoor unit 1, passes through the pipe 4, and flows into the heat medium relay unit 3. The high-pressure refrigerant that has flowed into the heat medium relay unit 3 is to split after passes through the opening/closing device 17*a*, and expanded by the expansion device 16*a* and the expansion device 16*b* and turns into low-temperature and low-pressure two-phase refrigerant. Note that the opening/closing device 17*b* is closed.

The two-phase refrigerants flow into the heat exchanger related to heat medium 15*a* and the heat exchanger related to heat medium 15*b* which are operating as evaporators, and turn into low-temperature and low-pressure gas refrigerants while cooling the heat medium by absorbing heat from the heat medium circulating in the heat medium circulating circuit B. The gas refrigerants flow out of the heat exchanger related to heat medium 15*a* and the heat exchanger related to heat medium 15*b* pass through the second refrigerant flow switching device 18*a* and the second refrigerant flow switching device 18*b*, flow out of the heat medium relay unit 3, pass through the pipe 4, and flow into the outdoor unit 1 again. The refrigerant that has flowed into the outdoor unit 1 passes through the check valve 13*d*, passes through the first refrigerant flow switching device 11 and the accumulator 19, and is sucked into the compressor 10 again.

At this time, the second refrigerant flow switching device 18*a* and the second refrigerant flow switching device 18*b* are interconnected with low-pressure pipes. Furthermore, the opening degree of the expansion device 16*a* is controlled such that the superheat obtained as a difference between the temperature detected by the third temperature sensor 35*a* and the temperature detected by the third temperature sensor 35*b* is maintained constant. Similarly, the opening degree of the expansion device 16*b* is controlled such that the superheat obtained as a difference between the temperature detected by the third temperature sensor 35*c* and the temperature detected by the third temperature sensor 35*d* is maintained constant.

Next, a flow of a heat medium in the heat medium circulating circuit B will be described.

In the cooling only operation mode, both in the heat exchanger related to heat medium 15*a* and the heat exchanger related to heat medium 15*b*, the cooling energy of a refrigerant is transmitted to a heat medium, and the pump 21*a* and the pump 21*b* allow the cooled heat medium to flow through the pipes 5. The heat medium that has been pressurized by and flowed out of the pump 21*a* and the pump 21*b* passes through the second heat medium flow switching device 23*a* and the second heat medium flow switching device 23*b*, and flows into the use-side heat exchanger 26*a* and the use-side heat exchanger 26*b*. When the heat medium absorbs heat from indoor air by the use-side heat exchanger 26*a* and the use-side heat exchanger 26*b*, cooling of the indoor space 7 is performed.

Then, the heat medium flows out of the use-side heat exchanger 26*a* and the use-side heat exchanger 26*b*, and flows into the heat medium flow control device 25*a* and the heat medium flow control device 25*b*. At this time, the heat medium flows into the use-side heat exchanger 26*a* and the use-side heat exchanger 26*b* in such a manner that the flow rate of the heat medium is controlled, with the operation of the heat medium flow control device 25*a* and the heat medium flow control device 25*b*, to a flow rate required for the air conditioning load necessary for inside the room. The heat medium that has flowed out of the heat medium flow control device 25*a* and the heat medium flow control device 25*b* pass through the first heat medium flow switching device 22*a* and the first heat medium flow switching device 22*b*, flow into the heat exchanger related to heat medium 15*a* and the heat exchanger related to heat medium 15*b*, and is sucked into the pump 21*a* and the pump 21*b* again.

In the pipes 5 for the use-side heat exchangers 26, the heat medium flows in the direction in which the heat medium from the second heat medium flow switching devices 23 passes through the heat medium flow control devices 25 and flows into the first heat medium flow switching devices 22. Furthermore, the air conditioning load necessary for the indoor space 7 can be provided by controlling to maintain a target value which is the difference between the temperature detected by the first temperature sensor 31*a* or the temperature detected by the first temperature sensor 31*b* and the temperature detected by the second temperature sensors 34. As the outlet temperature of the heat exchangers related to heat medium 15, either the temperature by the first temperature sensor 31*a* or the first temperature sensor 31*b* may be used. Alternatively, the average of these temperatures may be used. At this time, the opening degree of the first heat medium flow switching devices 22 and the second heat medium flow switching devices 23 is set to an intermediate value so that passages to both the heat exchanger related to heat medium 15*a* and the heat exchanger related to heat medium 15*b* can be secured.

For execution of the cooling only operation mode, since it is not necessary to cause the heat medium to be flowed into a use-side heat exchanger 26 (including thermo-off) in which air-conditioning load is not generated, the passage is closed by the corresponding heat medium flow control device 25 so that the heat medium does not flow into the use-side heat exchanger 26. In FIG. 3, the heat medium flows into the use-side heat exchanger 26*a* and the use-side heat exchanger 26*b* due to the presence of the air-conditioning load. However, since no air-conditioning load exists in the use-side heat exchanger 26*c* and the use-side heat exchanger 26*d*, the corresponding heat medium flow control device 25*c* and heat medium flow control device 25*d* are fully closed. In the case where air-conditioning load is generated in the use-side heat exchanger 26*c* or the use-side heat exchanger 26*d*, the heat medium flow control device 25*c* or the heat medium flow control device 25*d* are to be opened so that the heat medium circulates. This aspect is similarly applied to other operation modes.

[Heating Only Operation Mode]

Figure 4:
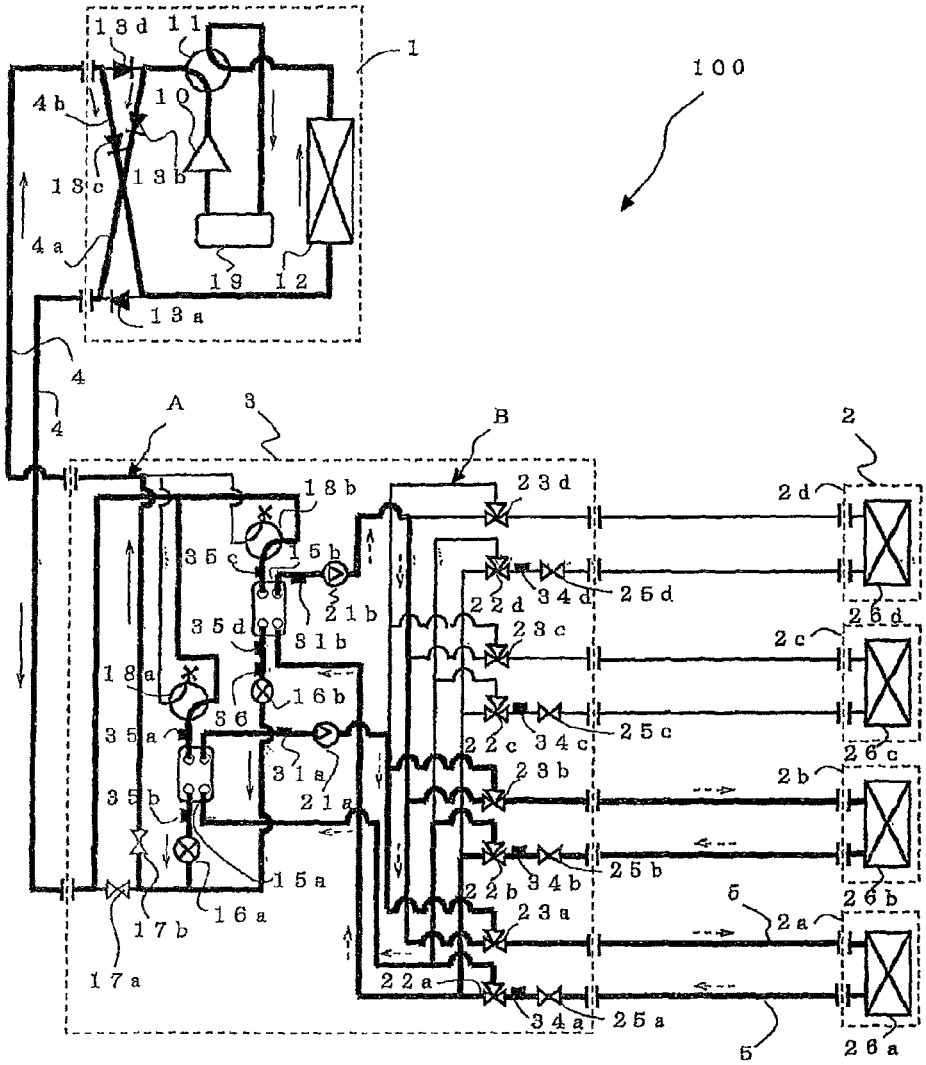
FIG. 4 is a refrigerant circuit diagram illustrating the flow of a refrigerant when the air-conditioning apparatus according to the embodiment of the present invention is in a heating only operation mode.

FIG. 4 is a refrigerant circuit diagram illustrating the flow of a refrigerant when the air-conditioning apparatus 100 is in the heating only operation mode. With reference to FIG. 4, the heating only operation mode will be described by way of an example of the case where heating load is generated only in the use-side heat exchanger 26*a* and the use-side heat exchanger 26*b*. In FIG. 4, pipes expressed by thick lines represent pipes through which a refrigerant and a heat medium flow. Furthermore, in FIG. 4, the direction of the flow of the refrigerant is expressed by solid-line arrows, and the direction of the flow of the heat medium is expressed by broken-line arrows.

In the case of the heating only operation mode illustrated in FIG. 4, the outdoor unit 1 causes the first refrigerant flow switching device 11 to switch in such a manner that a refrigerant discharged from the compressor 10 flows into the heat medium relay unit 3 without passing through the heat-source-side heat exchanger 12. In the heat medium relay unit 3, the pump 21*a* and the pump 21*b* are driven, the heat medium flow control device 25*a* and the heat medium flow control device 25*b* are opened while the heat medium flow control device 25*c* and the heat medium flow control device 25*d* are fully closed, so that the heat medium circulates between each of the heat exchanger related to heat medium 15*a* and the heat exchanger related to heat medium 15*b* and the use-side heat exchanger 26*a* and circulates between each of the heat exchanger related to heat medium 15*a* and the heat exchanger related to heat medium 15*b* and the use-side heat exchanger 26*b*.

First, a flow of a refrigerant in the refrigerant circulating circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow switching device 11 and the check valve 13*b*, and flows out of the outdoor unit 1. The high-temperature and high-pressure gas refrigerant that has flowed out of the outdoor unit 1 passes through the pipe 4 and flows into the heat medium relay unit 3. The high-temperature and high-pressure gas refrigerant that has flowed into the heat medium relay unit 3 is split, and the split gas refrigerant passes through the second refrigerant flow switching device 18*a* and the second refrigerant flow switching device 18*b* and flows into the heat exchanger related to heat medium 15*a* and the heat exchanger related to heat medium 15*b*.

The high-temperature and high-pressure gas refrigerant that has flowed into the heat exchanger related to heat medium 15*a* and the heat exchanger related to heat medium 15*b* is liquefied into a high-pressure liquid refrigerant while radiating heat to a heat medium circulating in the heat medium circulating circuit B. The liquid refrigerant that has flowed from the heat exchanger related to heat medium 15*a* and the heat exchanger related to heat medium 15*b* is expanded by the expansion device 16*a* and the expansion device 16*b* and turns into low-temperature and low-pressure two-phase refrigerant. The two-phase refrigerant passes through the opening/closing device 17*b*, flows out of the heat medium relay unit 3, passes through the pipe 4, and flows into the outdoor unit 1 again. Note that the opening/closing device 17*a* is closed.

The refrigerant that has flowed into the outdoor unit 1 passes through the check valve 13*c*, and flows into the heat-source-side heat exchanger 12 which is operating as an evaporator. Then, the refrigerant that has flowed into the heat-source-side heat exchanger 12 absorbs heat from outdoor air by the heat-source-side heat exchanger 12 and turns into a low-temperature and low-pressure gas refrigerant. The low-temperature and low-pressure gas refrigerant that has flowed from the heat-source-side heat exchanger 12 passes through the first refrigerant flow switching device 11 and the accumulator 19, and is sucked into the compressor 10 again.

At this time, the second refrigerant flow switching device 18*a* and the second refrigerant flow switching device 18*b* are interconnected with high-pressure pipes. Furthermore, the opening degree of the expansion device 16*a* is controlled such that the subcool obtained as the difference between the value obtained by converting the pressure detected by the pressure sensor 36 into a saturation temperature and the temperature detected by the third temperature sensor 35*b* is maintained constant. Similarly, the opening degree of the expansion device 16*b* is controlled such that the subcool obtained as the difference between the value obtained by converting the pressure detected by the pressure sensor 36 into a saturation temperature and the temperature detected by the third temperature sensor 35*d* is maintained constant. In the case where the temperature of the intermediate position of the heat exchangers related to heat medium 15 can be measured, the temperature at the intermediate position may be used instead of the pressure sensor 36. In this case, the system can be configured inexpensively.

Next, a flow of a heat medium in the heat medium circulating circuit B will be described.

In the heating only operation mode, both in the heat exchanger related to heat medium 15*a* and the heat exchanger related to heat medium 15*b*, the heating energy of refrigerant is transmitted to a heat medium, and the pump 21*a* and the pump 21*b* allow the heated heat medium to flow through the pipes 5. The heat medium that has been pressurized by and that flowed out of the pump 21*a* and the 21*b* passes through the second heat medium flow switching device 23*a* and the second heat medium flow switching device 23*b*, and flows into the use-side heat exchanger 26*a* and the use-side heat exchanger 26*b*. Then, when the heat medium radiates heat to indoor air by the use-side heat exchanger 26*a* and the use-side heat exchanger 26*b*, heating of the indoor space 7 is performed.

Then, the heat medium flows out of the use-side heat exchanger 26*a* and the use-side heat exchanger 26*b*, and flows into the heat medium flow control device 25*a* and the heat medium flow control device 25*b*. At this time, the heat medium flows into the use-side heat exchanger 26*a* and the use-side heat exchanger 26*b* in such a manner that the flow rate of the heat medium is controlled, with the operation of the heat medium flow control devices 25*a* and 25*b*, to a flow rate required for the air conditioning load necessary for inside the room. The heat medium that has flowed out of the heat medium flow control device 25*a* and the heat medium flow control device 25*b* passes through the first heat medium flow switching device 22*a* and the first heat medium flow switching device 22*b*, flows into the heat exchanger related to heat medium 15*a* and the heat exchanger related to heat medium 15*b*, and is sucked into the pump 21*a* and the pump 21*b* again.

In the pipes 5 for the use-side heat exchangers 26, the heat medium flow in the direction in which the heat medium from the second heat medium flow switching devices 23 passes through the heat medium flow control devices 25 and flows into the first heat medium flow switching devices 22. Furthermore, the air conditioning load necessary for the indoor space 7 can be provided by controlling to maintain the target value which is the difference between the temperature detected by the first temperature sensor 31*a* or the temperature detected by the first temperature sensor 31*b* and the temperature detected by the second temperature sensors 34. As the outlet temperature of the heat exchangers related to heat medium 15, either the temperature by the first temperature sensor 31*a* or the first temperature sensor 31*b* may be used. Alternatively, the average temperature of these temperatures may be used.

At this time, the opening degree of the first heat medium flow switching devices 22 and the second heat medium flow switching devices 23 is set to an intermediate value so that passages to both the heat exchanger related to heat medium 15*a* and the heat exchanger related to heat medium 15*b* can be secured. Originally, the use-side heat exchangers 26 should be controlled on the basis of the difference between the temperature of the inlet thereof and the outlet thereof. However, since the heat medium temperature on the inlet side of the use-side heat exchangers 26 is almost the same as the temperature detected by the first temperature sensors 31, using the first temperature sensors 31 reduces the number of temperature sensors. Accordingly, the system can be configured inexpensively.

[Cooling Main Operation Mode]

Figure 5:
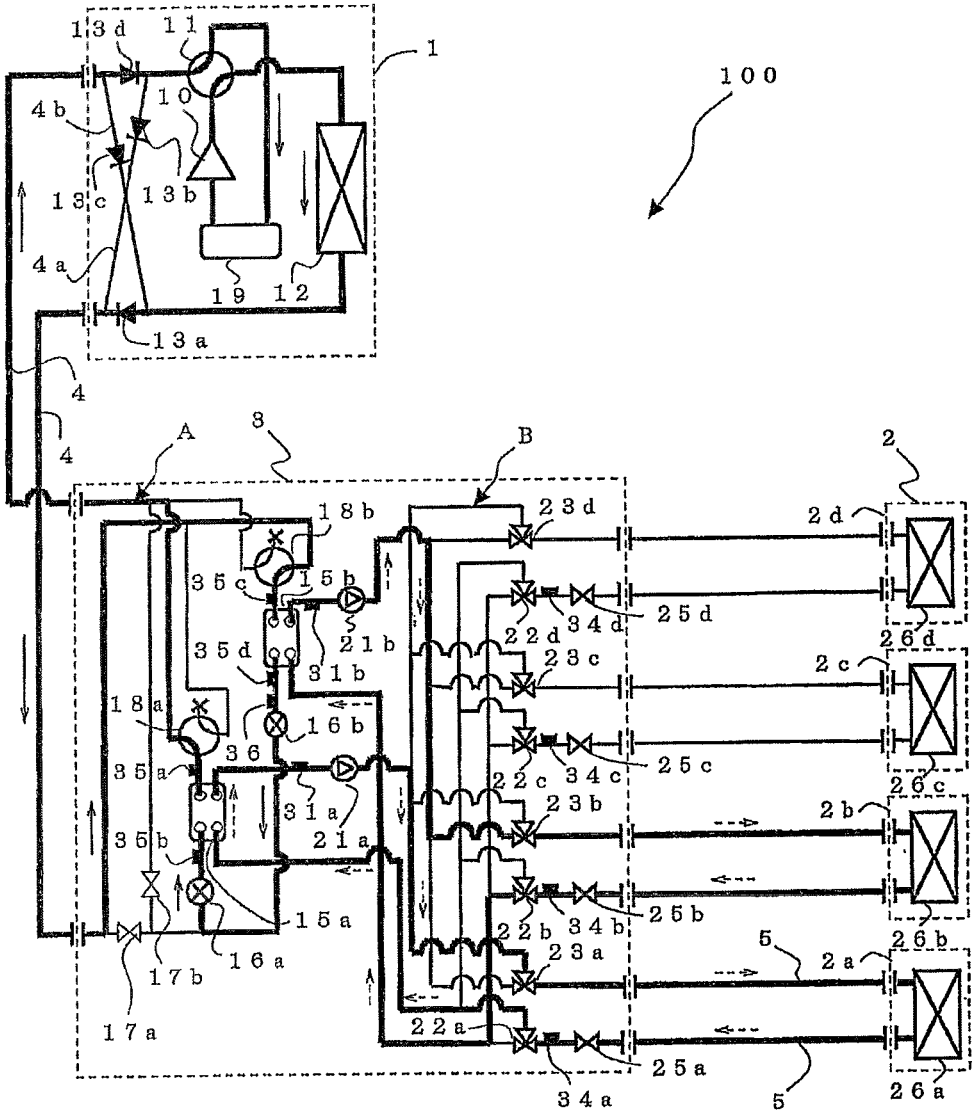
FIG. 5 is a refrigerant circuit diagram illustrating the flow of a refrigerant when the air-conditioning apparatus according to the embodiment of the present invention is in a cooling main operation mode.

FIG. 5 is a refrigerant circuit diagram illustrating a flow of a refrigerant when the air-conditioning apparatus 100 is in the cooling main operation mode. With reference to FIG. 5, the cooling main operation mode will be described by way of an example of the case where cooling load is generated in the use-side heat exchanger 26*a* and heating load is generated in the use-side heat exchanger 26*b*. In FIG. 5, pipes expressed by thick lines represent pipes through which a refrigerant and a heat medium circulate. Furthermore, in FIG. 5, the direction of the flow of the refrigerant is expressed by solid-line arrows and the direction of the flow of the heat medium is expressed by broken-line arrows.

In the case of the cooling main operation mode illustrated in FIG. 5, the outdoor unit 1 causes switching for the first refrigerant flow switching device 11 to switch in such a manner that the refrigerant discharged from the compressor 10 flows into the heat-source-side heat exchanger 12. In the heat medium relay unit 3, the pump 21*a* and the pump 21*b* are driven, the heat medium flow control device 25*a* and the heat medium flow control device 25*b* are opened while the heat medium flow control device 25*c* and the heat medium flow control device 25*d* are fully closed, so that the heat medium circulates between the heat exchanger related to heat medium 15*a* and the use-side heat exchanger 26*a* and circulates between the heat exchanger related to heat medium 15*b* and the use-side heat exchanger 26*b*.

First, a flow of a refrigerant in the refrigerant circulating circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow switching device 11, and flows into the heat-source-side heat exchanger 12. Then, the gas refrigerant is liquefied into a liquid refrigerant while radiating heat to outdoor air by the heat-source-side heat exchanger 12. The refrigerant that has flowed out of the heat-source-side heat exchanger 12 flows out of the outdoor unit 1, passes through the check valve 13*a* and the pipe 4, and flows into the heat medium relay unit 3. The refrigerant that has flowed into the heat medium relay unit 3 passes through the second refrigerant flow switching device 18*b*, and flows into the heat exchanger related to heat medium 15*b* which is operating as a condenser.

The refrigerant that has flowed into the heat exchanger related to heat medium 15*b* turns into the a refrigerant having a lower temperature while radiating heat to the heat medium circulating in the heat medium circulating circuit B. The refrigerant that has flowed out of the heat exchanger related to heat medium 15*b* is expanded by the expansion device 16*b*, and turns into a low-pressure two-phase refrigerant. The low-pressure two-phase refrigerant passes through the expansion device 16*a*, and flows into the heat exchanger related to heat medium 15*a* which is operating as an evaporator. The low-pressure tow-phase refrigerant that has flowed into the heat exchanger related to heat medium 15*a* turns into a low-pressure gas refrigerant while cooling the heat medium by absorbing heat from the heat medium circulating in the heat medium circulating circuit B. The gas refrigerant flows out of the heat exchanger related to heat medium 15*a*, passes through the second refrigerant flow switching device 18*a*, flows out of the heat medium relay unit 3, passes through the pipe 4, and flows into the outdoor unit 1 again. The refrigerant that has flowed into the outdoor unit 1 passes through the check valve 13*d*, the first refrigerant flow switching device 11, and the accumulator 19, and is sucked into the compressor 10 again.

At this time, the second refrigerant flow switching device 18*a* is interconnected with a low-pressure pipe, and meanwhile, the second refrigerant flow switching device 18*b* is interconnected with a high-pressure-side pipe. Furthermore, the opening degree of the expansion device 16*b* is controlled such that the superheat obtained as the difference between the temperature detected by the third temperature sensor 35*a* and the temperature detected by the third temperature sensor 35*b* is maintained constant. Furthermore, the expansion device 16*a* is fully opened and the opening/closing device 17*b* is closed. Note that the opening degree of the expansion device 16*b* may be controlled such that the subcool obtained as the difference between the value obtained by converting the pressure detected by the pressure sensor 36 into a saturation temperature and the temperature detected by the third temperature sensor 35*d* is maintained constant. Furthermore, the expansion device 16*b* may be fully opened, and the superheat or the subcool may be controlled using the expansion device 16*a*.

Next, a flow of a heat medium in the heat medium circulating circuit B will be described.

In the cooling main operation mode, the heat exchanger related to heat medium 15*b* transmits the heating energy of a refrigerant to a heat medium, and the pump 21*b* allows the heated heat medium to flow through the pipes 5. Furthermore, in the cooling main operation mode, the heat exchanger related to heat medium 15*a* transmits the cooling energy of the refrigerant to the heat medium, and the pump 21*a* allows the cooled heat medium to flow through the pipes 5. The heat medium that has been pressurized by and have flowed out of the pump 21*a* and the pump 21*b* passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, when the heat medium radiates heat to indoor air, heating of the indoor space 7 is performed. Furthermore, in the use-side heat exchanger 26*a*, when the heat medium absorbs heat from indoor air, cooling of the indoor space 7 is performed. At this time, the heat medium flows into the use-side heat exchanger 26*a* and the use-side heat exchanger 26*b* in such a manner that the flow rate of the heat medium is controlled, with the operation of the heat medium flow control device 25*a* and the heat medium flow control device 25*b*, to be a flow rate required for the air conditioning load necessary for inside the room. The heat medium that has passed through the use-side heat exchanger 26*b* and whose temperature has been slightly reduced passes through the heat medium flow control device 25*b* and the first heat medium flow switching device 22*b*, flows into the heat exchanger related to heat medium 15*b*, and is sucked into the pump 21*b* again. The heat medium that has passed through the use-side heat exchanger 26*a* and whose temperature has been slightly increased passes through the heat medium flow control device 25*a* and the first heat medium flow switching device 22*a*, flows into the heat exchanger related to heat medium 15*a*, and is sucked into the pump 21*a* again.

During this processing, with the operation of the first heat medium flow switching devices 22 and the second heat medium flow switching devices 23, the heated heat medium and the cooled heat medium are not mixed together and are individually introduced into the corresponding use-side heat exchangers 26 in which the heating load and the cooling load are generated. Note that in the pipes 5 for the use-side heat exchangers 26, the heat medium flows in the direction, for both the heating side and the cooling side, in which the heat medium from the second heat medium flow switching devices 23 passes through the heat medium flow control devices 25 and flow into the first heat medium flow switching devices 22. Furthermore, the air conditioning load necessary for the indoor space 7 can be provided by, for the heating side, controlling to maintain a target value which is the difference between the temperature detected by the first temperature sensor 31*b* and the temperature detected by the corresponding second temperature sensor 34 and, for the cooling side, controlling to maintain a target value which is the difference between the temperature detected by the corresponding second temperature sensor 34 and the temperature detected by the first temperature sensor 31.

[Heating Main Operation Mode]

Figure 6:
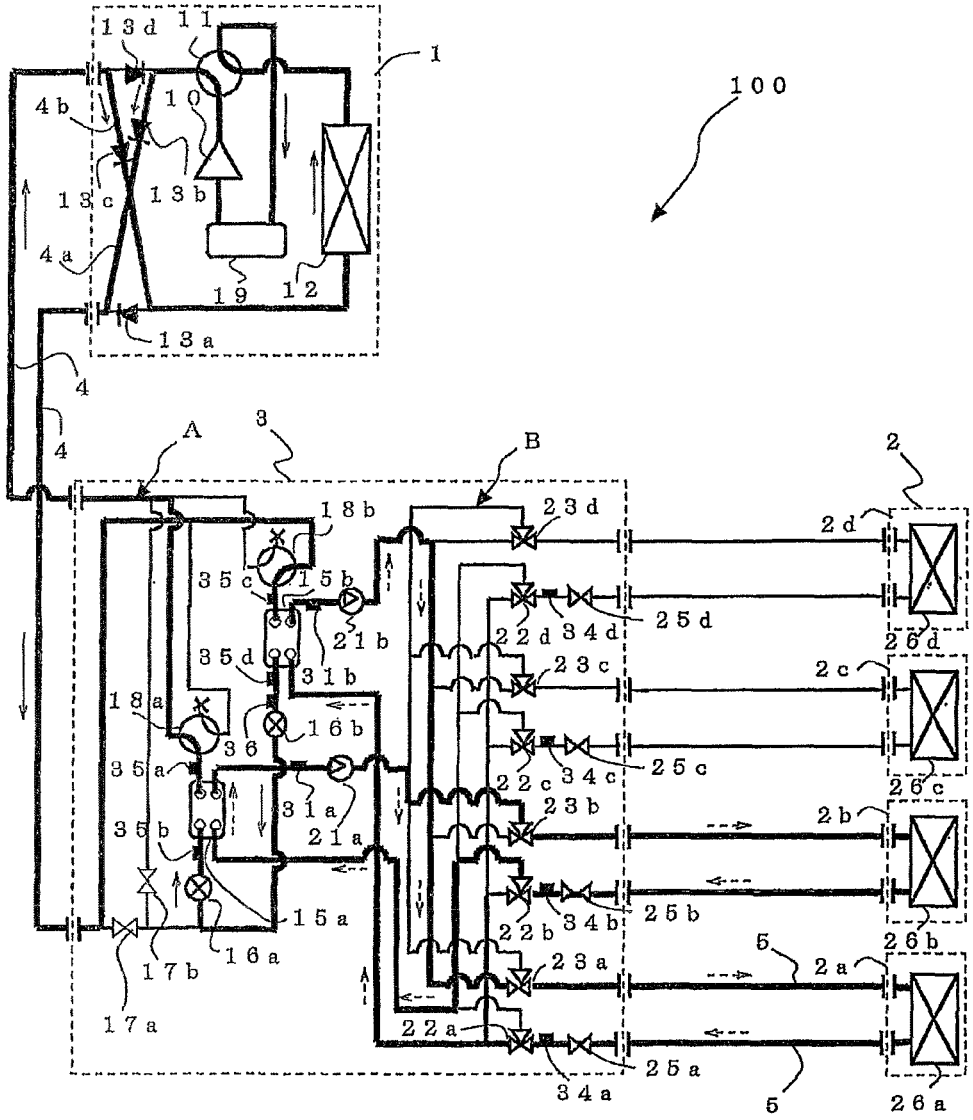
FIG. 6 is a refrigerant circuit diagram illustrating the flow of a refrigerant when the air-conditioning apparatus according to the embodiment of the present invention is in a heating main operation mode.

FIG. 6 is a refrigerant circuit diagram illustrating a flow of a refrigerant when the air-conditioning apparatus 100 is in the heating main operation mode. With reference to FIG. 6, the heating main operation mode will be described by way of an example of the case where heating load is generated in the use-side heat exchanger 26*a* and cooling load is generated in the use-side heat exchanger 26*b*. In FIG. 6, pipes expressed by thick lines represent pipes through which a refrigerant and a heat medium circulate. Furthermore, in FIG. 6, the direction of the flow of the refrigerant is expressed by solid-line arrows, and the direction of the flow of the heat medium is expressed by broken-line arrows.

In the case of the heating main operation mode illustrated in FIG. 6, the outdoor unit 1 performs switching for the first refrigerant flow switching device 11 in such a manner that the refrigerant discharged from the compressor 10 flows into the heat medium relay unit 3 without causing the refrigerant to pass through the heat-source-side heat exchanger 12. In the heat medium relay unit 3, the pump 21*a* and the pump 21*b* are driven, the heat medium flow control device 25*a* and the heat medium flow control device 25*b* are opened while the heat medium flow control device 25*c* and the heat medium flow control device 25*d* are fully closed, so that the heat medium circulates between the heat exchanger related to heat medium 15*a* and the use-side heat exchanger 26*b* and between the heat exchanger related to heat medium 15*b* and the use-side heat exchanger 26*a*.

First, a flow of a refrigerant in the refrigerant circulating circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow switching device 11 and the check valve 13*b*, and flows out of the outdoor unit 1. The high-temperature and high-pressure gas refrigerant that has flowed out of the outdoor unit 1 passes through the pipe 4, and flows into the heat medium relay unit 3. The high-temperature and high-pressured gas refrigerant that has flowed into the heat medium relay unit 3 passes through the second refrigerant flow switching device 18*b*, and flows into the heat exchanger related to heat medium 15*b* which is operating as a condenser.

The gas refrigerant that has flowed into the heat exchanger related to heat medium 15*b* is liquefied into a liquid refrigerant while radiating heat to the heat medium circulating in the heat medium circulating circuit B. The refrigerant that has flowed out of the heat exchanger related to heat medium 15*b* is expanded by the expansion device 16*b* and turns into a low-pressure two-phase refrigerant. The low-pressure two-phase refrigerant passes through the expansion device 16*a*, and flows into the heat exchanger related to heat medium 15*a* which is operating as an evaporator. The low-pressure two-phase refrigerant that has flowed into the heat exchanger related to heat medium 15*a* evaporates by absorbing heat from the heat medium circulating in the heat medium circulating circuit B, and thus cools the heat medium. The low-pressure two-phase refrigerant flows out of the heat exchanger related to heat medium 15*a*, passes through the second refrigerant flow switching device 18*a*, flows out of the heat medium relay unit 3, and flows into the outdoor unit 1 again.

The refrigerant that has flowed into the outdoor unit 1 passes through the check valve 13*c*, and flows into the heat-source-side heat exchanger 12 which is operating as an evaporator. Then, the refrigerant that has flowed into the heat-source-side heat exchanger 12 absorbs heat from outdoor air by the heat-source-side heat exchanger 12, and thus turns into a low-temperature and low-pressure gas refrigerant. The low-temperature and low-pressure gas refrigerant that has flowed out of the heat-source-side heat exchanger 12 passes through the first refrigerant flow switching device 11 and the accumulator 19, and is sucked into the compressor 10 again.

At this time, the second refrigerant flow switching device 18*a* is interconnected with a low-pressure-side pipe, and meanwhile, the second refrigerant flow switching device 18*b* is interconnected with a high-pressure-side pipe. Furthermore, the opening degree of the expansion device 16*b* is controlled such that the subcool obtained as the difference between the value obtained by converting the pressure detected by the pressure sensor 36 into a saturation temperature and the temperature detected by the third temperature sensor 35*b* is maintained constant. Furthermore, the expansion device 16*a* is fully opened, and the opening/closing device 17*a* is closed. Note that the expansion device 16*b* may be fully opened, and the subcool may be controlled using the expansion device 16*a*.

Next, a flow of a heat medium in the heat medium circulating circuit B will be described.

In the heating main operation mode, the heat exchanger related to heat medium 15*b* transmits the heating energy of a refrigerant to a heat medium, and the pump 21*b* allows the heated heat medium to flow through the pipes 5. Furthermore, in the heating main operation mode, the heat exchanger related to heat medium 15*a* transmits the cooling energy of a refrigerant to a heat medium, and the pump 21*a* allows the cooled heat medium to flow through the pipes 5. The heat medium that has been pressurized by and that have flowed out of the pump 21*a* and the pump 21*b* passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, when the heat medium absorbs heat from indoor air, cooling of the indoor space 7 is performed. Furthermore, in the use-side heat exchanger 26*a*, when the heat medium radiates heat to indoor space, heating of the indoor space 7 is performed. At this time, the heat medium flows into the use-side heat exchanger 26*a* and the use-side heat exchanger 26*b* in such a manner that the flow rate of the heat medium is controlled, with the operation of the heat medium flow control device 25*a* and the heat medium flow control device 25*b*, to be a flow rate required for the air conditioning load necessary for inside the room. The heat medium that has passed through the use-side heat exchanger 26*b* and whose temperature has been slightly increased passes through the heat medium flow control device 25*b* and the first heat medium flow switching device 22*b*, flows into the heat exchanger related to heat medium 15*a*, and is sucked into the pump 21*a* again. The heat medium that has passed through the use-side heat exchanger 26*a* and whose temperature has been slightly reduced passes through the heat medium flow control device 25*a* and the first heat medium flow switching device 22*a*, flows into the heat exchanger related to heat medium 15*b*, and is sucked into the pump 21*b* again.

During this processing, with the operation of the first heat medium flow switching devices 22 and the second heat medium flow switching devices 23, the heated heat medium and the cooled heat medium are not mixed together and are individually introduced into the corresponding use-side heat exchangers 26 in which the heating load and the cooling load are generated. Note that in the pipes 5 for the use-side heat exchangers 26, for both the heating side and the cooling side, the heat medium flows in the direction in which the heat medium from the second heat medium flow switching devices 23 passes through the heat medium flow control devices 25 and flows into the first heat medium flow switching devices 22. Furthermore, the air conditioning load necessary for the indoor space 7 can be provided by, for the heating side, controlling to maintain a target value which is the difference between the temperature detected by the first temperature sensor 31*b* and the temperature detected by the corresponding second temperature sensor 34 and, for the cooling side, controlling to maintain a target value which is the difference between the temperature detected by the corresponding second temperature sensor 34 and the temperature detected by the first temperature sensor 31*a*.

Figure 7:
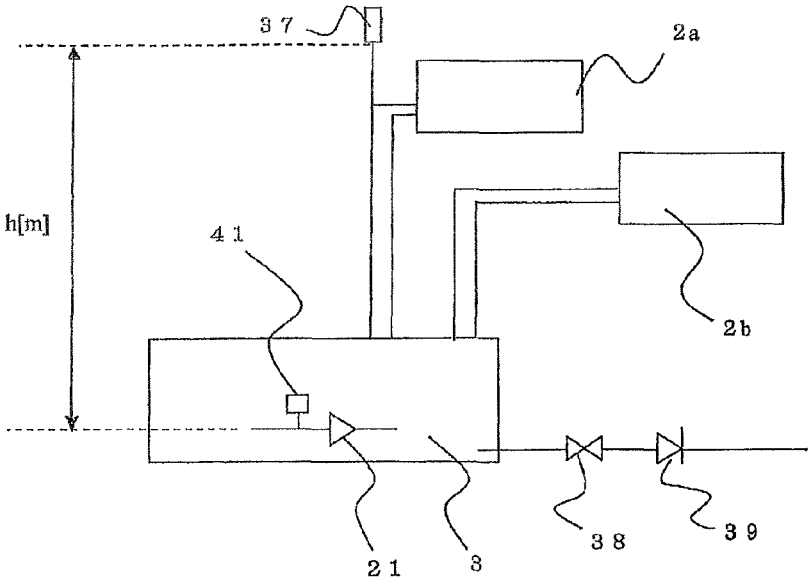
FIG. 7 is a diagram illustrating the installation positional (elevation) relationship between an automatic air purge valve and an indoor unit.
Figure 8:
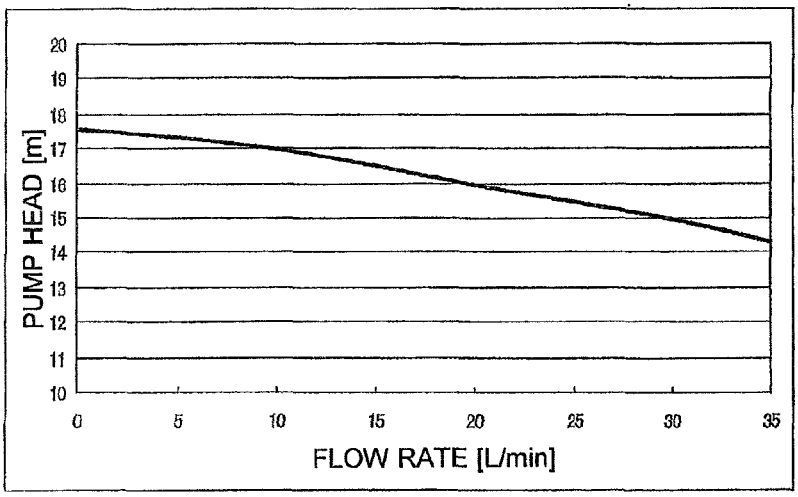
FIG. 8 is a reference diagram illustrating an example of the performance curve of a pump according to the embodiment of the present invention.
Figure 9:
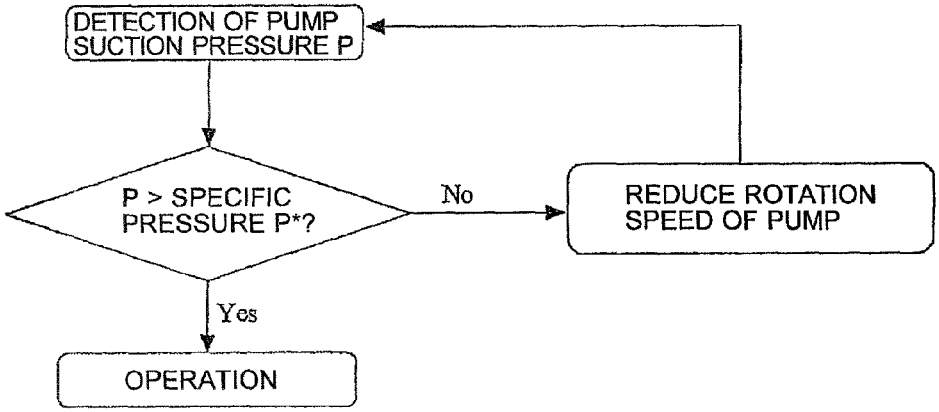
FIG. 9 is a flowchart illustrating an example of the control flow when an error is detected.

Next, a method for not causing the pressure to be negative in the heat medium circulating circuit B will be described with reference to FIG. 2 and FIGS. 7 to 8. FIG. 7 is a block diagram corresponding to FIG. 2, and illustrates the installation positional relationship (elevation difference h) between an automatic air purge valve 37 serving as automatic air discharging means and a pump 21. FIG. 8 represents the performance curve (flow rate vs. head) of a pump used in the present invention. Hereinafter, the explanation will be provided on the assumption that water is used for a heat medium and a water circuit is used as the heat medium circulating circuit B.

A method for supplying water to a water circuit (corresponding to the heat medium circulating circuit B) of an air-conditioning apparatus is performed by connecting the heat medium relay unit 3 and the water pipe 42 through the pressure reducing valve 38 and the check valve 39, as illustrated in FIGS. 2 and 7. In Embodiment 2, the pressure at the source of water is about 400 [kPa G]. The pressure at the secondary side of the pressure reducing valve 38 is 250 [kPa G]. That is, the water pressure is reduced, by the pressure reducing valve 38, from 400 [kPa G] to 250 [kPa G], and water is supplied to the water circuit of the heat medium relay unit 3. In the air-conditioning apparatus 100, the difference of elevation between the heat medium relay unit 3 and the indoor units 2 is about 8 m. Furthermore, in order to automatically discharge air in the water circuit, the automatic air purge valve 37 is arranged at the highest position of the air-conditioning apparatus system, that is, in this case, a position higher than the pump 21 by about 8 m. Thus, the automatic air purge valve 37 is arranged at a position in which the difference of elevation between the automatic air purge valve 37 and the inlet side of the pump 21 is about 8 m, and the difference of head pressure is 80 [kPa]. In the case where the charged pressure inside the water circuit is set to about 250 [kPa G] and operation is performed with, for example, a pump with a pump head of 30 m (300 [kPa]), the pressure at the inlet side of the pump is 100 [kPa G] (=250−300/2). Furthermore, since the head differential pressure is 80 [kPa], the pressure at the automatic air purge valve 37 is about 20 [kPa] (=100−80), and negative pressure is not generated in the automatic air purge valve 37. That is, in the entire water circuit, a charged pressure does not create negative pressure.

Although not illustrated in FIG. 7, an air purge valve is provided in the heat medium relay unit 3. In order to inject water into the heat medium relay unit 3, the air purge valve is opened and water is supplied while air in the water circuit is being removed. At the time when air is not discharged from the air purge valve, the air purge valve is turned into a closed state. In the state in which the water pipe 42 and the water circuit of the heat medium relay unit 3 are interconnected with each other, the pump 21 is operated, and air in the water circuit is removed from the automatic air purge valve 37. Note that air purge operation may be performed while cooling or heating is normally performed.

In the case where leakage occurs in the automatic air purge valve 37 or the first heat medium flow switching devices 22 or the heat medium flow control devices 25 on the pump suction side and the pumps 21 are operated when the water pressure is less than or equal to the atmospheric pressure (0 [kPa G]), air intrudes into the water circuit. The air that has intruded into the water circuit remains somewhere in the water circuit, and water does not flow eventually. In this state, since the pumps 21 continue to perform operation even though water does not flow through the pumps 21, the pumps 21 break down eventually. To this end, the air-conditioning apparatus 100 allows the water pressure on the pump suction side to be always maintained higher than the atmospheric pressure. A specific method for this will be described below in detail.

In the air-conditioning apparatus 100, unlike domestic hot-water supply systems and the like, a plurality of indoor units 2 may be installed, and the pipe length can be as much as 100 m. Thus, in order to withstand such installation conditions, the pumps 21 with high pump head are provided. The pump head necessary for such pumps is, although depending on the installation conditions, about 15 m (150 kPa) to about 30 m (300 kPa). For the use of pumps with a pump head of 30 m (300 kPa) or more, a higher designed pressure must be set. Thus, the maximum pump head Pp for the air-conditioning apparatus 100 is set to 30 m (300 kPa). Note that the pumps 21 having the performance in which "the maximum pump head is 17.5 m (175 kPa)" as illustrated in FIG. 8 are used by way of example. The rated operation point of the pumps 21 is a pump head of 15 m (150 kPa)".

As a position at which the pressure is the lowest in the water circuit, the two cases described below can be considered. First, in the case of an air-conditioning apparatus that allows ignoring the frictional loss in a pipe, the pressure loss depends only on the head pressure. Thus, the pressure near the highest position of the water circuit of the air-conditioning apparatus is the lowest. Meanwhile, in the case of an air-conditioning apparatus in which a pump is located lower than the highest position of a water circuit and a reduction in the pressure due to frictional loss in a pipe from the highest position of the water circuit of the air-conditioning apparatus to suction of the pump is greater than the head pressure of suction of the pump, the pressure near the suction side of the pump is the lowest. That is, the pressure at the above-mentioned two positions must not be negative pressure.

In the case where a pump 21 having the above-described performance is used and the water pressure of a water circuit when the operation is stopped is equal to the atmospheric pressure, the pressure at the suction side of the pump 21 is −75 [kPa G] (0 kPa−150 kPa (15 m)/2) and the pressure at the discharge side of the pump 21 is 75 [kPa G] (0 [kPa G]+150 kPa/2 (15 m)) at the time of rated operation of the pump 21. Thus, the pressure at the suction side of the pump 21 is negative. As a result, in the case where leakage occurs in the first heat medium flow switching devices 22 or the heat medium flow control devices 25, air is sucked into the water circuit. Furthermore, when the water pressure of the water circuit becomes lower than the atmospheric pressure, air is sucked also into the automatic air purge valve 37. Therefore, the pressure of regions of the water circuit corresponding to them must definitely not be negative.

The charged pressure that does not cause the water pressure of a water circuit to be negative must be determined in consideration of the head differential pressure of a pump. The charged pressure Pb can be calculated using Equation (1):

$$Pb-Pp/2>0 \Rightarrow Pb\ [\text{kPa G}] \geq (Pp/2)\ [\text{kPa}] \quad (1)$$

Furthermore, in general, the automatic air purge valve 37 is mounted in such an air-conditioning apparatus system. Due to the character of the automatic air purge valve 37, the automatic air purge valve 37 is generally installed at the highest position of the system. Since air is lighter than water, air is concentrated at the highest position.

For example, as illustrated in FIG. 7, let the automatic air purge valve 37 be installed at a position that is h [m] away from the suction side of the pump 21. Here, let the pressure at the pump suction side be Ps [kPa G]. The pressure of the automatic air purge valve 37 is reduced by the liquid head. The pressure Ph can be calculated using Equation (2):

$$Ph\ [\text{kPa}]=\rho\times g\times h/1000 \quad (2),$$

where ρ: the density of water [kg/m$^3$], g: the acceleration of gravity [m/s$^2$], and h: height [m].

The pressure Pay [kPa G] at the position of the automatic air purge valve 37 is represented by Equation (3):

$$Pav=Ps\cdot Ph=Ps-\rho\times g\times h/1000 \quad (3).$$

Furthermore, since the pressure at the suction side of the pump 21 needs to be higher than the atmospheric pressure, the pressure at the suction side of the pump 21 must satisfy:

$$Ps-\rho\times g\times h/1000\geq 0 \Rightarrow Ps\geq \rho\times g\times h/1000$$

In the case where the charged pressure Pb is taken into account, a differential pressure of the pump 21 also needs to be taken into account. Thus, when a charged pressure satisfying Equation (4) below is achieved, the pressure inside the water circuit is always maintained equal to or higher than the atmospheric pressure during the operation. Thus, suction of air does not occur.

$$Pb-Pp/2-\rho\times g\times h/1000\geq 0 \Rightarrow Pb\geq Pp/2-\rho\times g\times h/1000 \quad (4)$$

Since the density of water is 1000 [kg/m$^3$] and g=9.8 [m/s$^2$], when these values are substituted into Equation (4), the following equation is obtained:

$$Pb\ [\text{kPa G}]>Pp/2\ [\text{kPa}]-9.8\times h\ [\text{m}]$$

That is, by setting the secondary pressure of the pressure reducing valve 38 to Pb [kPa G] or more in Equation (4), the pressure of the water circuit can always be equal to or higher than the atmospheric pressure. Thus, air does not intrude into the water circuit of the air-conditioning apparatus 100, and the pump 21 can be prevented from breaking down. Consequently, the air-conditioning apparatus 100 with an improved reliability can be provided.

Furthermore, in some cases, interconnection with the water pipe 42 through the pressure reducing valve 38 and the check valve 39 may not be achieved. In this case, interconnection with the water pipe can be achieved using a hand pump or temporarily using a hose. Also in this case, as described above, by setting the charged pressure of the water circuit to Pb [kPa G] or higher, air intrusion can be prevented.

As illustrated in FIG. 2, the pressure sensor 40*a* is provided on the suction side of the pump 21*a*, and the pressure sensor 40*b* is provided on the suction side of the pump 21*b*. The two pressure sensors detect that the water circuit exhibits a specific pressure, which is a predetermined threshold value, and are provided for preventing air from intruding into the water circuit.

When one of the pressure sensors 40*a* and 40*b* detects the specific pressure, the air-conditioning apparatus 100 is stopped. In actuality, regarding variations in the pressure sensors 40*a* and 40*b*, it is preferable that the specific pressure for stopping the air-conditioning apparatus on the basis of response speed or the like is set in consideration of margins.

The above-mentioned specific pressure is affected by the vertical positional relationship between the pump 21 and the automatic air purge valve 37. In order to tolerate a difference of elevation of up to about 8 m (install the automatic air purge valve 37 at a position higher than the pump 21), the specific pressure may be set to 80 [kPa G]. When the automatic air purge valve 37 is located lower than the pump 21 or no automatic air purge valve is provided, there is no need to consider the influence of a difference of elevation and the specific pressure may be set to 0 [kPa G]. As described above, the specific pressure depends on the tolerance of the difference of elevation between a pump and an automatic air purge valve.

As illustrated in FIG. 7, normally, in order that the pressure inside a water circuit is not equal to or higher than a certain relief valve set pressure Pmax, a relief valve 41 is mounted in the water circuit. When the relief valve set pressure exceeds Pmax, the relief valve 41 discharges water inside the circuit out of the system, so that the pressure inside the circuit does not exceed Pmax. The charged pressure Pb [kPa G] may be set on the basis of the relief valve set pressure Pmax.

The case where the relief valve 41 for which the relief valve set pressure Pmax is set to 430 kPa [kPa G] is used will be described. There is an inter-individual variability (variation) in the relief valve 41. The lower limit Pmaxl of the relief valve set pressure is 380 kPa [kPa G] and the upper limit Pmaxh of the relief valve set pressure is 480 kPa [kPa G]. Furthermore, when the tolerance of the difference of elevation between the heat medium relay unit 3 and the automatic air purge valve 37 is up to 6 m, the head pressure Pl based on the difference of elevation is 60 [kPa]. In addition, the pump head of the pump is set to 300 kPa. In this case, by setting the charged pressure of the water circuit to Pb=380−((380−60)/2)=220 [kPa G], the pressure at the pump suction side is 70 [kPa G], and the pressure of the automatic air purge valve 37 located higher by 6 m is not negative. Thus, the pressure of the water circuit is not negative. Furthermore, the pressure at the pump discharge side is 370 [kPa G], and the air-conditioning apparatus 100 can be operated without operating the relief valve 41. When a formula for calculating the charged pressure is generalized, Equation (5) is obtained:

$$\text{Charged pressure}=(P\text{max}+Pl)/2 \quad (5)$$

However, in actuality, various variation factors (variations in pump etc.) exist. A tolerance of 10 kPa is provided for the relief valve set pressure Pmax 1 (380 [kPaG]), a tolerance β of 10 [kPaG] is provided for the lower limit pressure (60 kPaG) on the pump suction side, and finally, the charged pressure can be calculated using Equation (6) including the tolerance β:

$$(P\text{max}+Pl)/2\cdot 10\ \text{kPa}<\text{charged pressure}<(P\text{max}+Pl)/2+10\ \text{kPa} \quad (6)$$

In the description provided above, a relief valve with a large variation is used. The case of a relief valve without variation that is operated at the relief valve set pressure Pmax will now be described. The difference of elevation between the automatic air purge valve 37 and the pump 21 is set to 6 m. The head pressure is 60 [kPa] and the reference charged pressure is 245 [kPaG] (=(430+60)/2) on the basis of Equation (5). The pump head of the pump is set to 300 [kPa]. The pressure at the pump discharge side is 395 [kPaG] (=245+150), and meanwhile, the pressure at the pump suction side is 95 [kPaG]. A tolerance of 35 kPa is provided for the relief valve set pressure Pmax (430 [kPaG]), and a tolerance β of 35 [kPaG] is provided for the lower limit pressure (60 kPaG) on the pump suction side. In this case, for the charged pressure, Equation (6) is expressed as follows:

$$(P\max+Pl)/2-35\text{ kPa}<\text{charged pressure}<(P\max+Pl)/2+35\text{ kPa} \quad (7)$$

When no automatic air purge valve is provided or when a pump is located at a position higher than an automatic air purge valve, Pl=0 and the reference charged pressure is 215 [kPaG] (=430/2). The pump head of the pump is set to 300 [kPa]. The pressure at the pump discharge side is 365 [kPaG] (=215+150), and meanwhile, the pressure at the pump suction side is 0 [kPaG]. A tolerance of 65 kPa is provided for the relief valve set pressure Pmax (430 [kPaG]), and a tolerance β of 65 [kPaG] is provided for the lower limit pressure (0 kPaG) on the pump suction side. In this case, for the charged pressure, Equation (6) is expressed as follows:

$$(P\max+Pl)/2-65\text{ kPa}<\text{charged pressure}<(P\max+Pl)/2+65\text{ kPa} \quad (8)$$

The charged pressure is expressed by a numerical range, that is a range between the maximum system elevation difference and a relief valve set pressure. Since the minimum value of the maximum elevation difference of such a system is about 8 m, the minimum value of the charged pressure is about 80 kPaG. Furthermore, in the case of such a system, in order to lighten a product and decrease the cost, principal parts of a water circuit that are made of plastic are often used, in general. The designed pressure of such parts is about 1000 kPaG. When margins are taken into consideration, a pressure of about 500 kPaG is often adopted as the maximum pressure of a relief valve. That is, the upper limit of the charged pressure is about 500 kPaG. As is clear from the above description, a range between about 80 kPaG and about 500 kPaG can be regarded as the range of the charged pressure.

Figure 10:
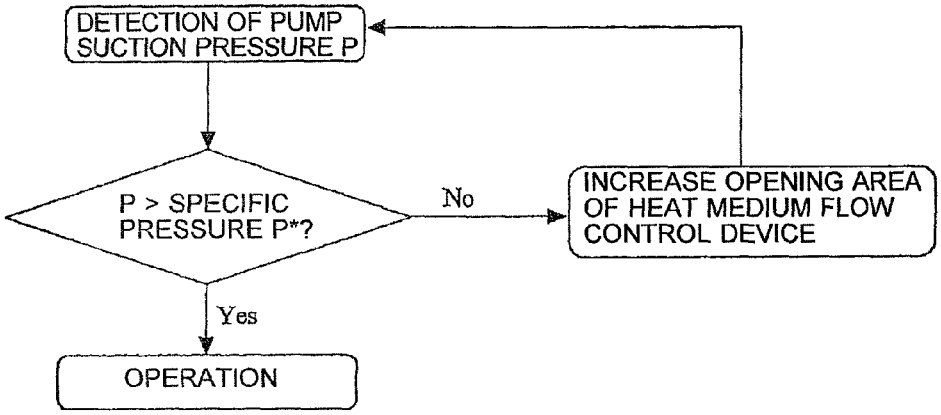
FIG. 10 is a flowchart illustrating an example of the control flow when an error is detected.

When the suction pressure P of the pump 21 is detected and an error is detected in the suction pressure P (suction pressure P specific pressure P*), the rotation speed of the pump 21 is reduced and the pump head of the pump 21 is reduced. Accordingly, the pressure at the pump suction side can be increased. Here, the specific pressure P* is a value that is set in advance as a prevention threshold and that is greater than 0 [kPa G]. FIG. 10 illustrates the flow of the control described above.

Figure 11:
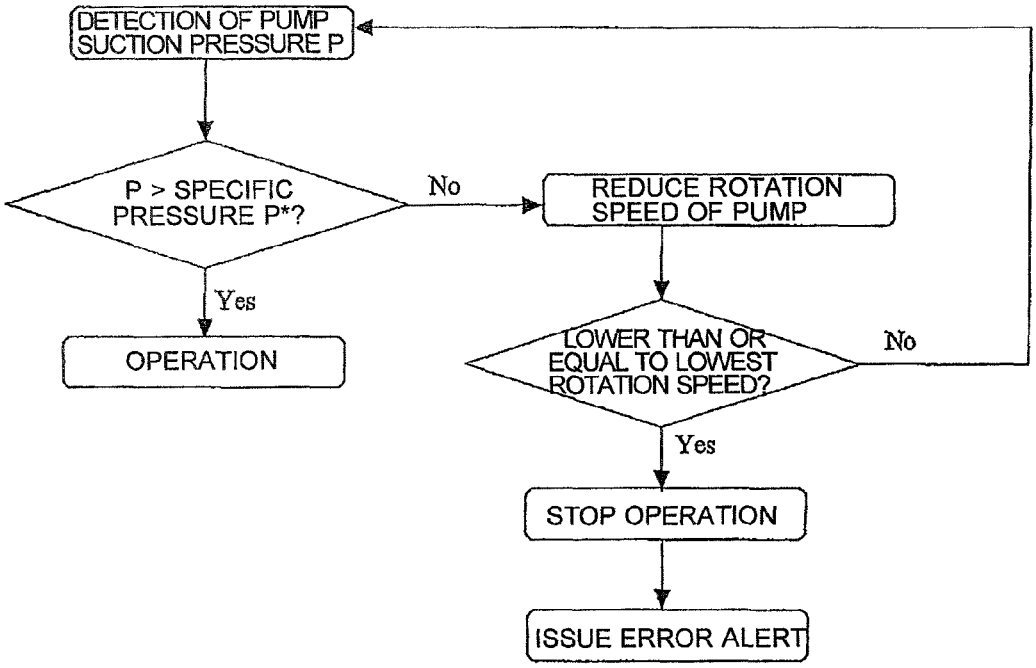
FIG. 11 is a flowchart illustrating an example of the control flow when an error is detected.

Furthermore, when the suction pressure P of the pump 21 is detected and an error is detected in the suction pressure P (suction pressure P specific pressure P*), the opening area of the heat medium flow control device 25 is increased so that the pressure loss is reduced. Accordingly, the pressure at the suction side of the pump 21 can be prevented from being reduced. FIG. 11 illustrates the flow of the control described above.

Furthermore, when an error is detected or it is estimated that an error occurs, the air-conditioning apparatus 100 is stopped and an error alert is issued. Accordingly, an error can be found quickly, and the system can be recovered and improved before the air-conditioning apparatus 100 breaks down.

FIG. 11 illustrates an example in which in the case where an error in the suction pressure P of the pump 21 is detected, the rotation speed of the pump 21 is reduced, and when the rotation speed is equal to or slower than the lowest rotation speed, the air-conditioning apparatus 100 is stopped and an error alert is issued.

Figure 12:
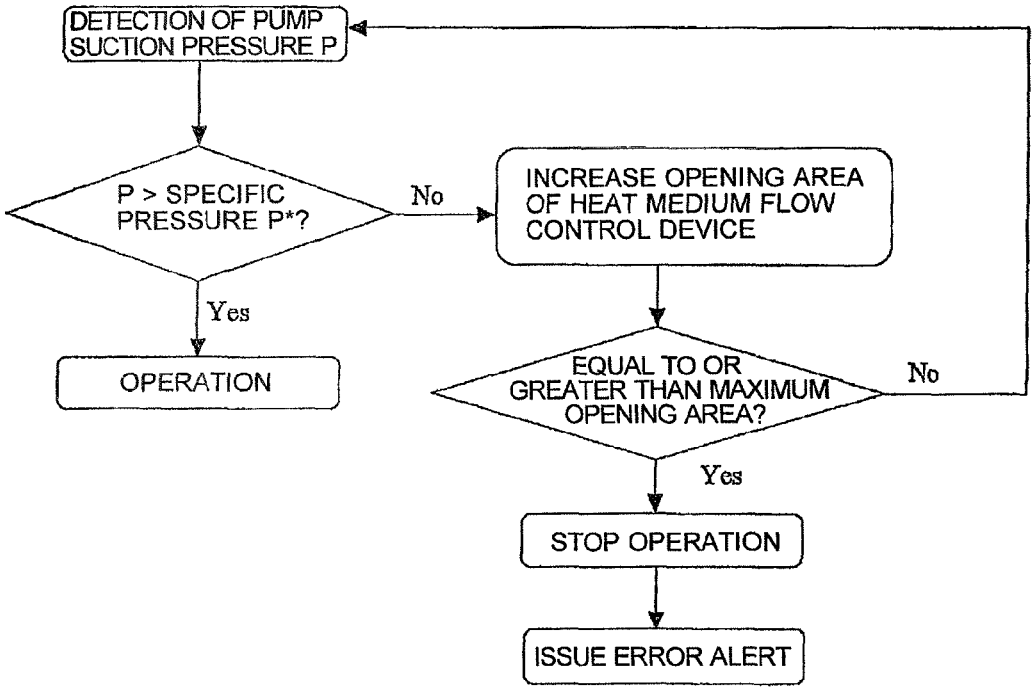
FIG. 12 is a flowchart illustrating an example of the control flow when an error is detected.

FIG. 12 illustrates an example in which in the case where an error in the suction pressure P of the pump 21 is detected, the opening area of the heat medium flow control device 25 is increased, and when the opening area is equal to or greater than the maximum opening area, the air-conditioning apparatus 100 is stopped and an error alert is issued.

[Refrigerant]

An example of the case where R410A is used as a refrigerant has been described above. However, a refrigerant such as R404A, R407C, CO2, HFO-1234yf, HFO-1234ze, or the like may be used.

[Heat Medium]

As a heat medium, for example, brine (antifreeze), water, a liquid mixture of brine and water, a liquid mixture of water and an additive having a high anticorrosive effect, or the like may be used. Thus, in the air-conditioning apparatus 100, even if a heat medium leaks through the indoor units 2 to the indoor space 7, since a highly safe material is used for a heat medium, the use of the highly safe material contributes to improvement in the safety.

Furthermore, when the state (heating or cooling) of the heat exchanger related to heat medium 15*b* and the heat exchanger related to heat medium 15*a* changes between the cooling main operation mode and the heating main operation mode, hot water is cooled into cold water and cold water is heated into hot water, leading to a waste of energy. In the air-conditioning apparatus 100, both in the cooling main operation mode and the heating main operation mode, the heat exchanger related to heat medium 15*b* is configured to be always on the heating side and the heat exchanger related to heat medium 15*a* is configured to be always on the cooling side.

Furthermore, in the case where both heating load and cooling load are generated in the use-side heat exchangers 26, a first heat medium flow switching device 22 and a second heat medium flow switching device 23 corresponding to a use-side heat exchanger 26 that is performing heating operation are switched to a passage connected to the heat exchanger related to heat medium 15*b* for heating, and a first heat medium flow switching device 22 and a second heat medium flow switching device 23 corresponding to a use-side heat exchanger 26 that is performing cooling operation are switched to a passage connected to the heat exchanger related to heat medium 15*a* for cooling. Accordingly, in each of the indoor units 2, heating operation and cooling operation can be arbitrarily performed.

Although the air-conditioning apparatus 100 that is capable of performing cooling and heating mixed operation has been described, the air-conditioning apparatus 100 is not limited thereto. For example, even with the configuration in which one heat exchanger related to heat medium 15 and one expansion device 16 are provided, a plurality of use-side heat exchangers 26 and a plurality of heat medium flow control devices 25 are connected in parallel to the heat exchanger related to heat medium 15 and the expansion device 16, and only one of cooling operation and heating operation can be performed, since the water pressure at a pump suction side is always maintained higher than the atmospheric pressure, the above-mentioned aspect can be applied.

Furthermore, it is needless to mention that a similar application may also be made to the case where only one use-side heat exchanger 26 and one heat medium flow control device 25 are connected. In addition, obviously, there is no problem when as the heat exchanger related to heat medium 15 and the expansion device 16, a plurality of devices performing the same operation are provided. Furthermore, although the case where the heat medium flow control devices 25 are built in the heat medium relay unit 3 has been described by way of example, the heat medium flow control devices 25 are not necessarily built in the heat medium relay unit 3. The heat medium flow control devices 25 may be built in the indoor units 2, or the heat medium flow control devices 25 may be configured separately from the heat medium relay unit 3 and the indoor units 2.

Furthermore, in general, an air-sending device is often mounted in each of the heat-source-side heat exchanger 12 and the use-side heat exchangers 26 so that condensation and evaporation are urged by air sending. However, an air-sending device is not necessarily mounted in each of the heat-source-side heat exchanger 12 and the use-side heat exchangers 26. For example, panel heaters or the like that use radiation may be used as the use-side heat exchangers 26, and a device of a water cooled type that transports heat by water or antifreeze may be used as the heat-source-side heat exchanger 12. That is, devices of any type may be used as the heat-source-side heat exchanger 12 and the use-side heat exchangers 26 as long as the devices have a configuration capable of radiating and absorbing heat.

REFERENCE SIGNS LIST

1 outdoor unit, 2 (2*a* to 2*d*) indoor unit, 3 heat medium relay unit, 4 (4*a* and 4*b*) pipe, 5 pipe, 6 outdoor space, 7 indoor space, 8 space, 9 structure, 10 compressor, 11 first refrigerant flow switching device, 12 heat-source-side heat exchanger, 13*a* to 13*d* check valve, 15 (15*a* and 15*b*) heat exchanger related to heat medium, 16 (16*a* and 16*b*) expansion device, 17*a* and 17*b* opening/closing device, 18 (18*a* and 18*b*) second refrigerant flow switching device, 19 accumulator, 21 (21*a* and 21*b*) pump, 22 (22*a* to 22*d*) first heat medium flow switching device, 23 (23*a* to 23*d*) second heat medium flow switching device, 25 (25*a* to 25*d*) heat medium flow control device, 26 (26*a* to 26*d*) use-side heat exchanger, 31 (31*a* and 31*b*) first temperature sensor, 34 (34*a* to 34*d*) second temperature sensor, 35 (35*a* to 35*d*) third temperature sensor, 36 pressure sensor, 37 automatic air purge valve, 38 pressure reducing valve, 39 check valve, 40*a* pressure sensor, 40*b* pressure sensor, 41 relief valve, 100 air-conditioning apparatus

The invention claimed is:

1. An air-conditioning apparatus comprising:

a refrigerant circuit in which a compressor, a heat-source-side heat exchanger, an expansion device, and a refrigerant-side passage of a heat exchanger related to heat medium are connected in series and through which a heat-source-side refrigerant circulates;

a heat medium circulating circuit in which a heat-medium-side passage of the heat exchanger related to heat medium, a pump, a use-side heat exchanger, and a heat medium flow control device are connected and through which a heat medium circulates;

a relief valve that controls a pressure in the heat medium circulating circuit not to be equal to or higher than a specific set pressure; and a pressure detecting device provided near the suction side of the pump, wherein the compressor and the heat-source-side heat exchanger are arranged in an outdoor unit, wherein the heat exchanger related to heat medium, the expansion device, the pump, and the heat medium flow control device are arranged in a heat medium relay unit, wherein the use-side heat exchanger is arranged in an indoor unit, wherein the heat medium circulating circuit is a closed circuit and the maximum pump head Pp of the pump is 175 kPa or more, a pressure near at least a suction side of the pump or a pressure near at least a highest position in the heat medium circulating circuit is set to a charged pressure that is maintained equal to or higher than an atmospheric pressure during operation of the pump, wherein the charged pressure satisfies "charged pressure [kPa G]≥(pump maximum pump head Pp/2) [kPa]" and is set within a range between approximately 80 and approximately 500 [kPa G] on the basis of a set pressure for the relief valve, wherein operation is controlled such that a detected pressure detected by the pressure detecting device is always maintained equal to or higher than a specific pressure that is higher than 0 [kPa G], and wherein the relief valve is separate from the heat medium flow control device.

2. The air-conditioning apparatus of claim 1, wherein pressure from a connection entrance of the heat medium relay unit on a return side thereof from the indoor unit to an inlet of the pump on the suction side thereof is set to the charged pressure that is maintained equal to or higher than the atmospheric pressure during the operation of the pump.

3. The air-conditioning apparatus of claim 1, further comprising:

an automatic air discharging unit that automatically discharges air in the heat medium circulating circuit, wherein when the automatic air discharging unit is placed at a position higher than the pump, the charged pressure [kPa G] satisfies "(Pmax+Pl)/2−65 kPa<charged pressure <(Pmax+Pl)/2+65 kPa", where a head differential pressure between the automatic air discharging unit and the pump is represented by Pl [kPa] and the lower limit of the set pressure for the relief valve is represented by Pmax [kPa G], and wherein when the automatic air discharging unit is located at a position lower than the pump, the charged pressure [kPa G] satisfies "(Pmax/2−65 kPa<charged pressure <(Pmax/2)+65 kPa", where the lower limit of the set pressure for the relief valve is represented by Pmax [kPa G].

4. The air-conditioning apparatus of claim 1, wherein when the detected pressure detected by the pressure detecting device is equal to or lower than the specific pressure or when it is estimated that the detected pressure detected by the pressure detecting device is equal to or lower than the specific pressure, a rotation speed of the pump is reduced or an opening area of the heat medium flow control device is increased.

5. The air-conditioning apparatus of claim 1, wherein when the detected pressure detected by the pressure detecting device is equal to the specific pressure or it is estimated that the detected pressure detected by the pressure detecting device is equal to or lower than the specific pressure, operation of the air-conditioning apparatus is stopped and an error alert is issued.

6. The air-conditioning apparatus of claim 1, wherein the specific pressure is a head differential pressure based on a difference of elevation between the pump and the automatic air discharging unit.

7. The air-conditioning apparatus of claim 6, wherein the head differential pressure is approximately 80 kPa.

8. The air-conditioning apparatus of claim 1, further comprising:

An automatic air discharging unit that automatically discharges air in the heat medium circulating circuit; and a pressure detecting device that is provided near the suction side of the pump, wherein in a case where the automatic air discharging unit is placed at a position lower than the pump, the operation is controlled such that the detected pressure detected by the pressure detecting device is always maintained higher than 0 [kPa G], and when the detected pressure detected by the pressure detecting device is equal to or lower than a predetermined specific pressure or when it is estimated that the detected pressure detected by the pressure detecting device is equal to or lower than the specific pressure, the rotation speed of the pump is reduced or the opening area of the heat medium flow control device is increased.

9. The air-conditioning apparatus of claim 8, wherein when the detected pressure detected by the pressure detecting device is equal to the specific pressure or when it is estimated that the detected pressure detected by the pressure detecting device is equal to or lower than the specific pressure, the operation of the air-conditioning apparatus is stopped and an error alert is issued.

10. The air-conditioning apparatus of claim 1, wherein when the automatic air discharging unit that automatically discharges air in the heat medium circulating circuit is placed at a position higher than the pump by h [m], the charged pressure satisfies "charged pressure [kPa G]>(pump maximum pump head Pp/2) [kPa]−9.8×water density ρ [kg/m$^3$]×h [m]/1000".

* * * * *